US009943721B2

(12) United States Patent
Hockridge

(10) Patent No.: US 9,943,721 B2
(45) Date of Patent: Apr. 17, 2018

(54) FLIP AND DIP HANDLE SYSTEM FOR PERFORMING DIP EXERCISES ON AN EXERCISE MACHINE

(71) Applicant: Hoist Fitness Systems, Inc., Poway, CA (US)

(72) Inventor: Bruce Hockridge, San Diego, CA (US)

(73) Assignee: HOIST FITNESS SYSTEMS, INC., Poway, CA (US)

( * ) Notice: Subject to any disclaimer, the term of this patent is extended or adjusted under 35 U.S.C. 154(b) by 139 days.

(21) Appl. No.: 14/992,978

(22) Filed: Jan. 11, 2016

(65) Prior Publication Data

US 2016/0199691 A1 Jul. 14, 2016

Related U.S. Application Data

(60) Provisional application No. 62/102,192, filed on Jan. 12, 2015.

(51) Int. Cl.
*A63B 21/068* (2006.01)
*A63B 21/00* (2006.01)
(Continued)

(52) U.S. Cl.
CPC ..... *A63B 21/4027* (2015.10); *A63B 21/068* (2013.01); *A63B 21/0628* (2015.10); *A63B 21/4033* (2015.10); *A63B 23/0355* (2013.01); *A63B 23/03533* (2013.01); *A63B 23/1209* (2013.01); *A63B 23/1218* (2013.01); *A63B 23/1227* (2013.01); *A63B 21/005* (2013.01); *A63B 21/008* (2013.01); *A63B 21/00047* (2013.01); *A63B 21/00069* (2013.01);
(Continued)

(58) Field of Classification Search
CPC ..... A63B 23/1227; A63B 2210/00–2210/50; A63B 21/068; A63B 21/4035; A63B 23/03533; A63B 23/0355; A63B 23/1209; A63B 23/03525; A63B 23/03541; A63B 23/1245; A63B 23/03575; A63B 3/00; A63B 21/0421; A63B 21/0628; A63B 21/1618–21/1636; A63B 21/4029; A63B 21/00047; A63B 21/00185
See application file for complete search history.

(56) References Cited

U.S. PATENT DOCUMENTS 5,011,139 A * 4/1991 Towley, III ..... A63B 21/00181 482/100
5,722,921 A * 3/1998 Simonson ..... A63B 21/155 482/100

(Continued)

FOREIGN PATENT DOCUMENTS

FR 2892638 A1 * 5/2007 ..... A63B 21/00047

*Primary Examiner* — Gregory Winter
(74) *Attorney, Agent, or Firm* — Gordon Rees Scully Mansukhani LLP; David R. Heckadon

(57) ABSTRACT

An exercise machine for performing dip exercises, having: a stationary main frame; first and second mounting brackets connected to the stationary main frame; first and second dip handle assemblies connected to the mounting brackets, each dip handle assembly having a first exercise arm, a first stop plate, and a first arm mount hub, wherein the first and second dip handle assemblies are each configured to be converted between an exercise position and a storage position while connected to the exercise machine.

21 Claims, 16 Drawing Sheets

(51) Int. Cl.

| | |
|---|---|
| ***A63B 23/12*** | (2006.01) |
| ***A63B 21/062*** | (2006.01) |
| *A63B 21/005* | (2006.01) |
| *A63B 21/008* | (2006.01) |
| *A63B 21/012* | (2006.01) |
| *A63B 21/02* | (2006.01) |
| *A63B 23/04* | (2006.01) |
| *A63B 23/035* | (2006.01) |
| *A63B 21/055* | (2006.01) |
| *A63B 23/00* | (2006.01) |
| *A63B 71/00* | (2006.01) |

(52) U.S. Cl.

CPC ..... *A63B 21/00072* (2013.01); *A63B 21/0085* (2013.01); *A63B 21/00181* (2013.01); *A63B 21/00185* (2013.01); *A63B 21/012* (2013.01); *A63B 21/023* (2013.01); *A63B 21/026* (2013.01); *A63B 21/0552* (2013.01); *A63B 21/0557* (2013.01); *A63B 21/154* (2013.01); *A63B 21/156* (2013.01); *A63B 21/4029* (2015.10); *A63B 21/4035* (2015.10); *A63B 21/4047* (2015.10); *A63B 23/03525* (2013.01); *A63B 23/03541* (2013.01); *A63B 23/03558* (2013.01); *A63B 23/03575* (2013.01); *A63B 23/1245* (2013.01); *A63B 2023/006* (2013.01); *A63B 2023/0411* (2013.01); *A63B 2071/009* (2013.01); *A63B 2208/0204* (2013.01); *A63B 2208/029* (2013.01); *A63B 2208/0214* (2013.01); *A63B 2208/0228* (2013.01); *A63B 2209/02* (2013.01); *A63B 2210/00* (2013.01); *A63B 2210/50* (2013.01); *A63B 2225/09* (2013.01); *A63B 2225/093* (2013.01)

(56) References Cited

U.S. PATENT DOCUMENTS

| | | | | |
|---|---|---|---|---|
| 7,632,221 | B1 * | 12/2009 | Kolander | A63B 21/154 482/102 |
| 8,057,367 | B2 | 11/2011 | Giannelli et al. | |
| 8,070,658 | B2 | 12/2011 | Giannelli et al. | |
| 8,708,872 | B2 | 4/2014 | Giannelli et al. | |
| 8,992,392 | B2 | 3/2015 | Giannelli et al. | |
| 9,089,737 | B2 | 7/2015 | Giannelli et al. | |
| 9,199,119 | B2 * | 12/2015 | Hetrick | A63B 23/0216 |
| 9,211,434 | B2 | 12/2015 | Giannelli et al. | |
| 9,320,934 | B1 * | 4/2016 | Pringle | A63B 23/03558 |
| 2005/0009675 | A1 * | 1/2005 | Van Den Heever | A63B 21/0615 482/131 |
| 2007/0161475 | A1 * | 7/2007 | Kerry | A63B 69/0057 482/140 |
| 2009/0048082 | A1 * | 2/2009 | Abbott | A63B 23/0211 482/140 |
| 2009/0253559 | A1 * | 10/2009 | Maresh | A63B 23/1209 482/93 |
| 2010/0279827 | A1 * | 11/2010 | Farnsworth | A63B 23/1209 482/54 |
| 2011/0028280 | A1 * | 2/2011 | Adams | A63B 21/154 482/94 |
| 2012/0329626 | A1 * | 12/2012 | Meredith | A63B 21/062 482/142 |
| 2015/0057137 | A1 * | 2/2015 | Chen | A63B 23/03583 482/135 |
| 2016/0166874 | A1 * | 6/2016 | Sheeler | A63B 21/1627 482/40 |
| 2017/0144008 | A1 * | 5/2017 | Brown | A63B 21/00047 |

* cited by examiner

FLIP AND DIP HANDLE SYSTEM FOR PERFORMING DIP EXERCISES ON AN EXERCISE MACHINE

CROSS-REFERENCE TO RELATED APPLICATIONS

This application claims the benefit of provisional U.S. Patent Application Ser. No. 62/102,192, which was filed in the U.S. Patent and Trademark Office on Jan. 12, 2015. Application Ser. No. 62/102,192 is incorporated herein by reference in its entirety.

STATEMENT REGARDING FEDERALLY SPONSORED RESEARCH OR DEVELOPMENT

This application is not the subject of any federally sponsored research or development.

THE NAMES OF THE PARTIES TO A JOINT RESEARCH AGREEMENT

There have been no joint research agreements entered into with any third parties.

FIELD OF THE INVENTION

The present invention generally relates to fitness equipment. Specifically, the embodiments of the present invention are directed to an exercise machine for performing dip exercises, including a flip and dip handle system that allows the dip handle assemblies to be rotated between an exercise position and a storage position.

BACKGROUND OF THE INVENTION

Dip exercises are a popular exercise that typically uses the exerciser's body weight as the exercise resistance. In a dip exercise, the exerciser begins with his arms extending straight down along his sides and uses his arms to support his body on a pair of typically parallel dip handles. The exerciser then bends his arms at the elbow to lower his body, before straightening his arms to push his body up. The exerciser thus returns to the exercise start position.

Traditional dip exercise machines include a fixed pair of dip handles. Dedicated dip exercise machines are not versatile and take up a significant amount of space in an exercise area. Even multi-purpose exercise machines that include fixed dip handles are not particularly versatile because the dip handles extend outwardly, using a significant amount of space and limiting the exerciser's ability to move while performing other exercises.

The dip handles of a multi-purpose exercise machine may be made removable, but this carries additional disadvantages. For instance, when the dip handles are removed from the exercise machine, they must be stored, which requires a certain amount of space that then cannot be used for other purposes. Additionally, removal and reinstallation of the dip handles takes time, which may interfere with and interrupt an exercise routine, particularly where the exerciser wishes to perform an exercise circuit that includes dip exercises in addition to other exercise movements.

Consequently, a need exists for an exercise machine for performing dip exercises that includes dip handles that can be quickly moved between an exercise position and a storage position. The embodiments of the present invention solve this problem by providing an exercise machine for performing dip exercises, including a flip and dip handle system that allows the dip handle assemblies to be rotated between an exercise position and a storage position. Other advantages of the present invention will become apparent to one skilled in the art.

SUMMARY OF THE INVENTION

An embodiment of the present invention is directed to a dip handle system, the dip handle system including a mounting bracket; an arm mount hub connected to the mounting bracket, which includes a pivot shaft, a pair of locking apertures that respectively define an exercise position and a storage position for the dip handle system, and a pair of stop lugs; a bearing housing pivotally mounted to the arm mount hub, which includes a bore into which the pivot shaft is received, a stop plate, and a pull-pin barrel; one or more bearings located between the pivot shaft and the bore of the bearing housing; a stop feature on the stop plate for engaging the stop lugs of the arm mount hub, wherein the stop feature and stop lugs define the travel limits for the dip handle system; a pull pin inserted into the pull-pin barrel for selectively engaging the locking apertures of the arm mount hub to lock the dip handle system into the respective exercise position or storage position; an exercise arm connected to the bearing housing; and a dip handle connected to the exercise arm.

Another embodiment of the present invention is directed to an exercise machine for performing dip exercises, the exercise machine including a main frame and a dip handle system, the dip handle system including a mounting bracket attached to the main frame; an arm mount hub connected to the mounting bracket, which includes a pivot shaft, a pair of locking apertures that respectively define an exercise position and a storage position for the dip handle system, and a pair of stop lugs; a bearing housing pivotally mounted to the arm mount hub, which includes a bore into which the pivot shaft is received, a stop plate, and a pull-pin barrel; one or more bearings located between the pivot shaft and the bore of the bearing housing; a stop feature on the stop plate for engaging the stop lugs of the arm mount hub, wherein the stop feature and stop lugs define the travel limits for the dip handle system; a pull pin inserted into the pull-pin barrel for selectively engaging the locking apertures of the arm mount hub to lock the dip handle system into the respective exercise position or storage position; an exercise arm connected to the bearing housing; and a dip handle connected to the exercise arm.

BRIEF DESCRIPTION OF THE DRAWINGS

Preferred features of the embodiments of the present invention are disclosed in the accompanying drawings, wherein similar reference characters denote similar elements throughout the several views, and wherein.

DETAILED DESCRIPTION

Figure 1:
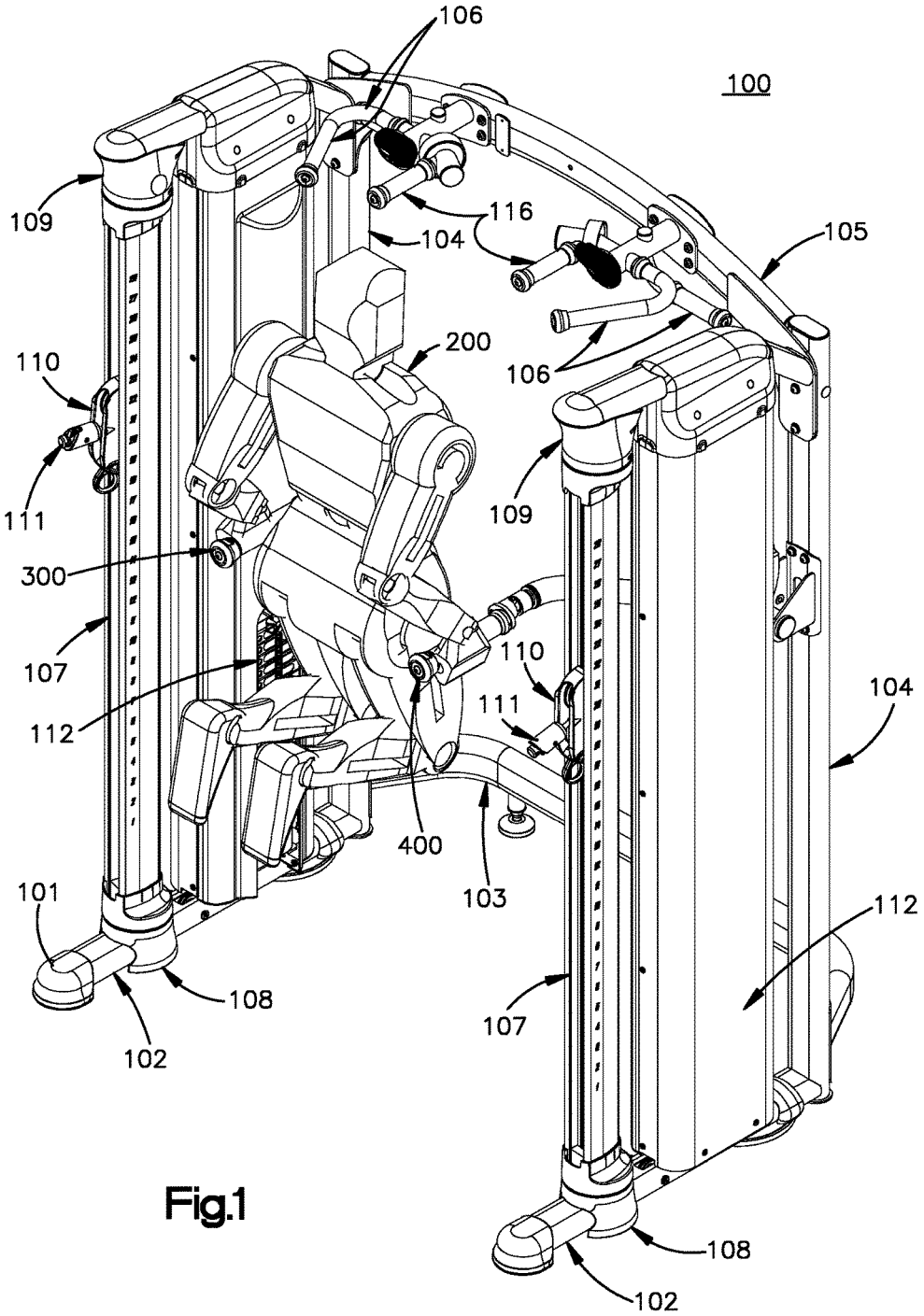
FIG. 1 is a back-right side isometric view of a dual hi-lo pulley functional trainer unit including a flip and dip handle system with the dip handle assemblies in the exercise position and including an exerciser in position to perform a dip exercise.

The embodiments of the present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete and will convey the scope of the invention to those skilled in the art.

In the following description, like reference characters designate like or corresponding parts throughout the figures. It is to be understood that the phraseology and terminology used in the following description are used for the purpose of description and enablement, and should not be regarded as limiting. Additionally, in the following description, it is understood that terms such as "top," "bottom," "side," "front," "back," "inner," "outer," and the like, are words of convenience and are not to be construed as limiting terms.

A flip and dip handle system for performing dip exercises on an exercise machine is described herein. The embodiments of the present invention are designed to provide a handle system for performing dip exercises on an exercise machine that can be quickly moved between a use position and a storage position.

Figure 2:
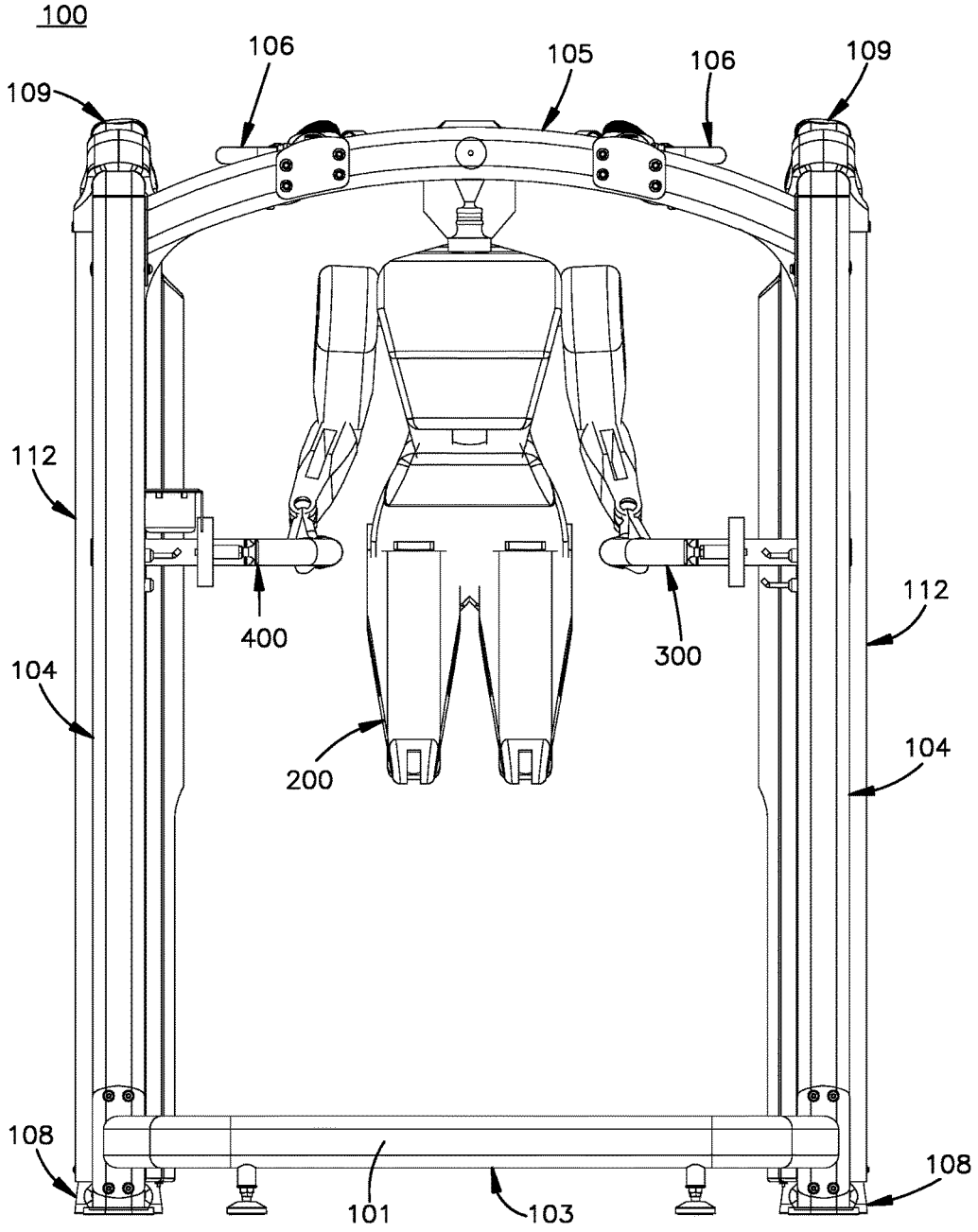
FIG. 2 is a front side view of the dual hi-lo pulley functional trainer unit as depicted in FIG. 1.
Figure 3:
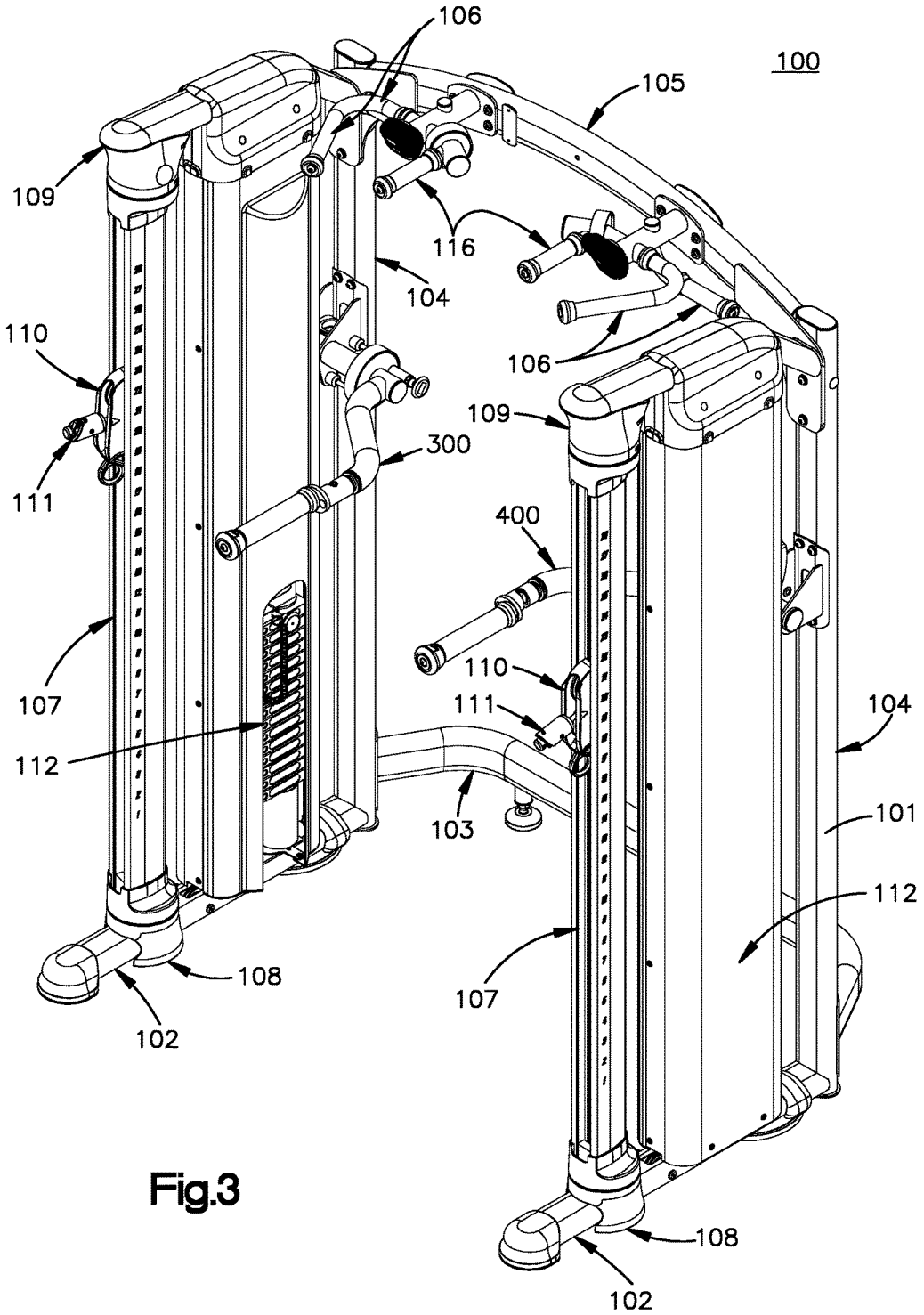
FIG. 3 is a back-right side isometric view of the dual hi-lo pulley functional trainer unit as depicted in FIG. 1, but with the exerciser omitted.
Figure 4:
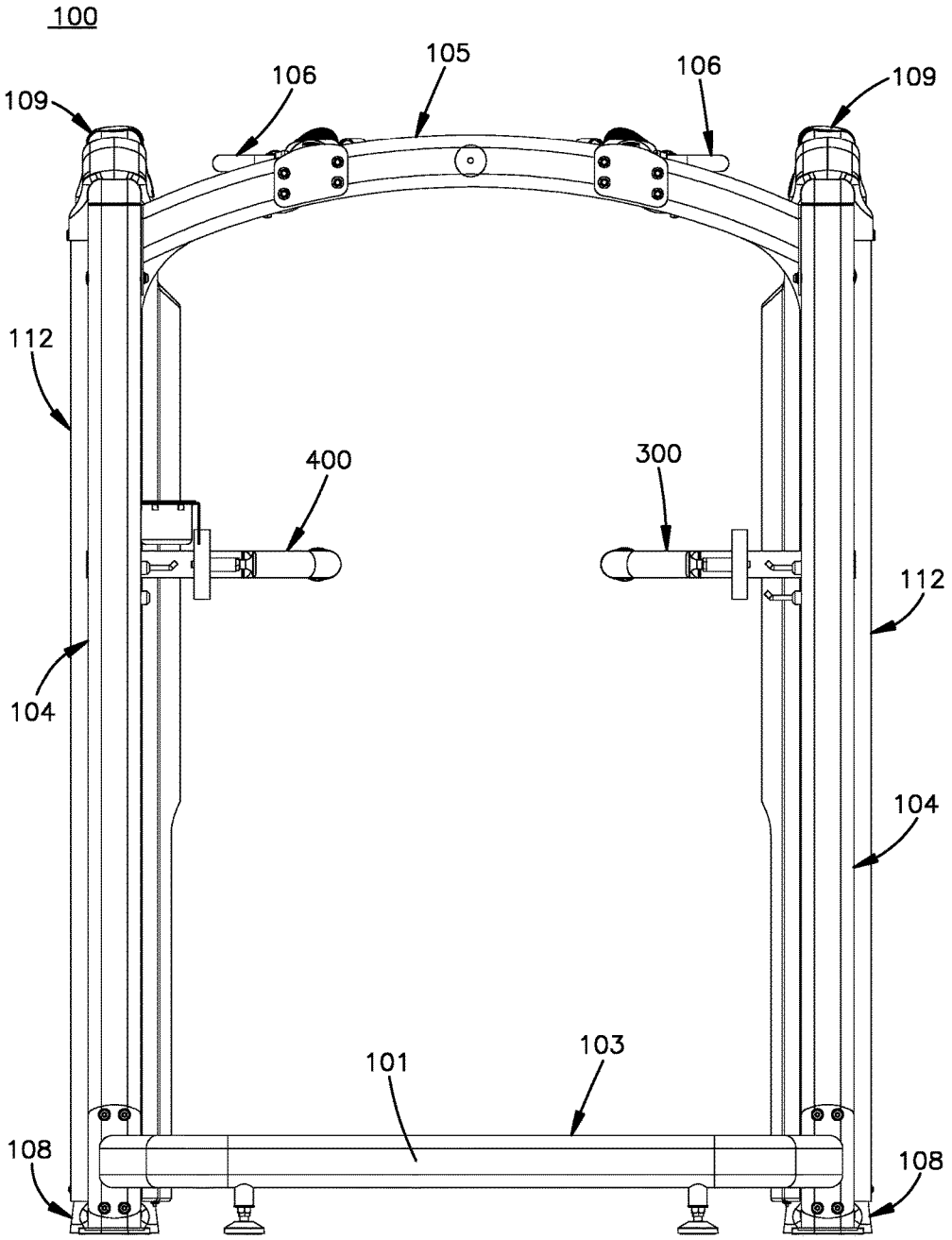
FIG. 4 is a front side view of the dual hi-lo pulley functional trainer unit as depicted in FIG. 3.
Figure 5:
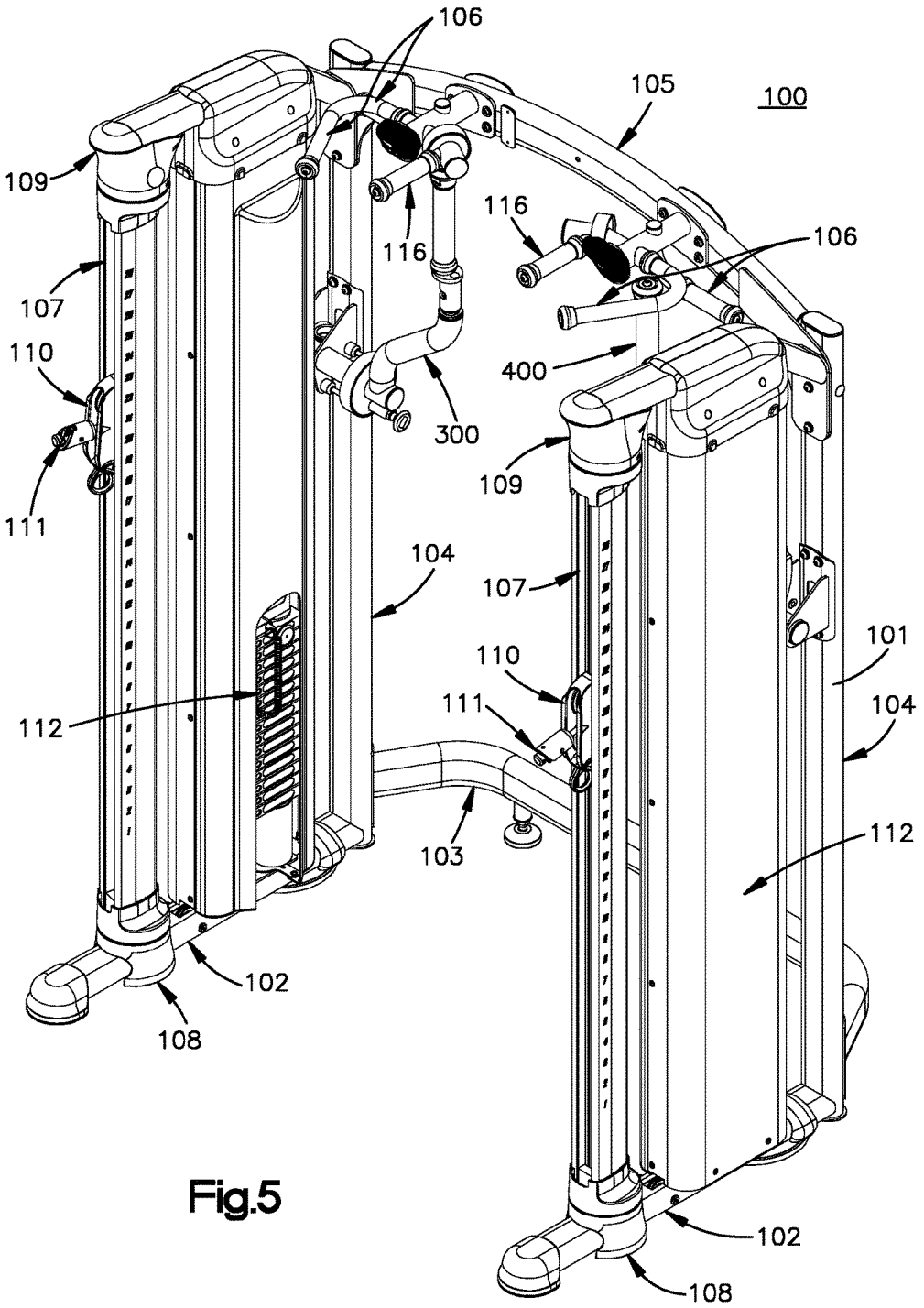
FIG. 5 is a back-right side isometric view of the dual hi-lo pulley functional trainer unit as depicted in FIG. 3, but with the dip handle assemblies in the storage position.
Figure 6:
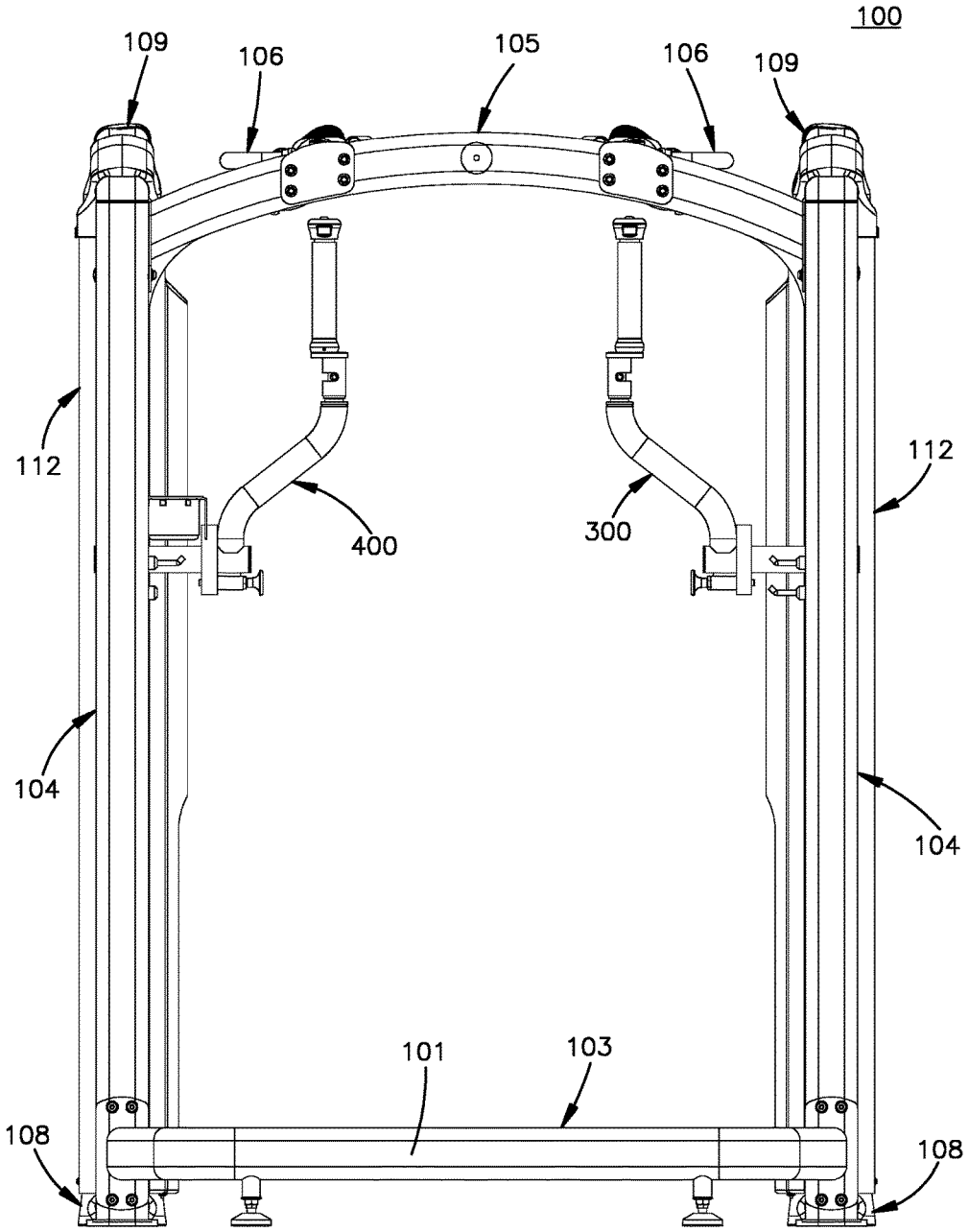
FIG. 6 is a front side view of the dual hi-lo pulley functional trainer unit as depicted in FIG. 5.

An embodiment of the present invention includes an exercise machine 100 as depicted in FIGS. 1-8. The exercise machine 100 of FIGS. 1-8 is a dual hi-lo pulley functional trainer unit. However, one of ordinary skill will appreciate that the handle system of the present invention may be adaptable to a number of different exercise machines known in the art. Thus, the present invention is not limited to the dual hi-lo pulley functional trainer unit as depicted in FIGS. 1-8. FIGS. 1 and 2 depict an exerciser 200 in position to perform a dip exercise.

As best shown in FIGS. 1-6, the exercise machine 100 of the present embodiment includes a stationary main frame 101. The main frame 101 is a fixed frame structure and includes horizontal side struts 102; a horizontal cross strut 103 connecting the horizontal side struts 102 at their front ends; support uprights 104; and a horizontal connecting strut 105 connecting the support uprights 104 at their top ends. The exercise machine 100 further includes multiple pull-up grips 106, 116 associated with the horizontal connecting strut 105 for performing pull-up or chin-up exercises. At least one pair of the pull-up grips are adjustable pull-up grips 116 that may be selectively rotated between a fore-aft orientation, wherein each adjustable pull-up grip 116 is substantially horizontal and points toward the back of the exercise machine 100 (FIGS. 1, 3, 5), and a side-to-side orientation, wherein each adjustable pull-up grip 116 is substantially horizontal and points inwardly toward the center of the exercise machine 100. The adjustable pull-up grips 116 are rotatably adjustable, similar to the adjustable hand grips 40 described in U.S. Patent Application Publication No. 2012-0329626 A1, which is herein incorporated by reference. The fore-aft orientation of the adjustable pull-up grips 116, is illustrated and described in U.S. Patent Application Publication No. 2012-0329626 A1 as position 40B. And the side-to-side orientation of the adjustable pull-up grips 116, is illustrated and described in U.S. Patent Application Publication No. 2012-0329626 A1 as position 40A.

The exercise machine 100, as depicted in FIGS. 1-6, further includes a pair of vertical columns 107. Each of the vertical columns 107 are rotatably mounted between an upper pivot mount 109 and a lower pivot mount 108 that is connected to the horizontal side strut 102. Thus, each of the vertical columns 107 is rotatable about its longitudinal axis. A pulley carriage 110 is mounted on each of the vertical columns 107 and may be vertically adjusted up and down, along the length of the respective vertical column 107.

The exercise machine 100 further includes a source of resistance, which in the case of the embodiment depicted in FIGS. 1-6 is a pair of selectorized weight stacks 112. One of ordinary skill in the art will appreciate, however, that the source of resistance may include, without limitation, a weight stack, weight plates mounted on pegs, or other types of resistance such as hydraulic, pneumatic, electromagnetic, friction, springs, elastically bending rods, elastic bands, or the like. A cable and pulley system (not shown) includes a cable attached at one end to the selectorized weight stack 112 and an opposite pull end 111. The pull end 111 of the cable passes through the pulley carriage 110, such that when the pulley carriage 110 is adjusted up or down, the pull end 111 of the cable also moves up or down. The pull ends 111, of exercise machine 100, may be connected to various exercise attachments for performing exercises.

An exerciser may perform an exercise by pulling or pushing one or both pull ends 111 away from the respective pulley carriage 110. Because the vertical columns 107 are rotatable, and the pulley carriage 110 is vertically adjustable, the path of exercise motion and direction of exercise resistance is highly adjustable. When the exerciser performs an exercise by pulling or pushing a pull end 111 away from its respective pulley carriage 110, the cable travels through the cable and pulley system and lifts the amount of weight selected within the selectorized weight stack 112.

Figure 7:
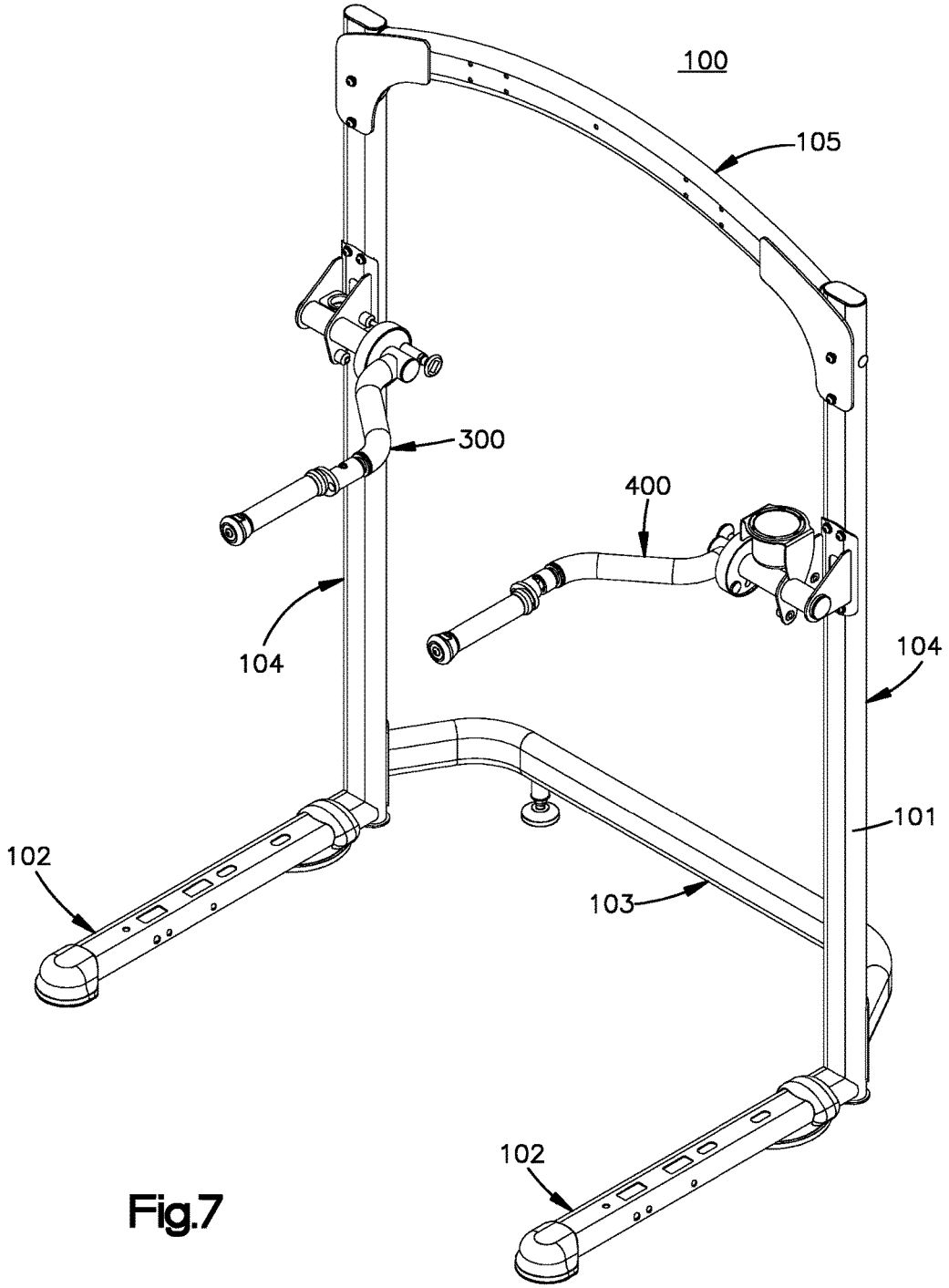
FIG. 7 is a back-right side isometric view of the dual hi-lo pulley functional trainer unit as depicted in FIG. 3, but with many parts of the exercise machine omitted to more clearly show the flip and dip handle system.
Figure 8:
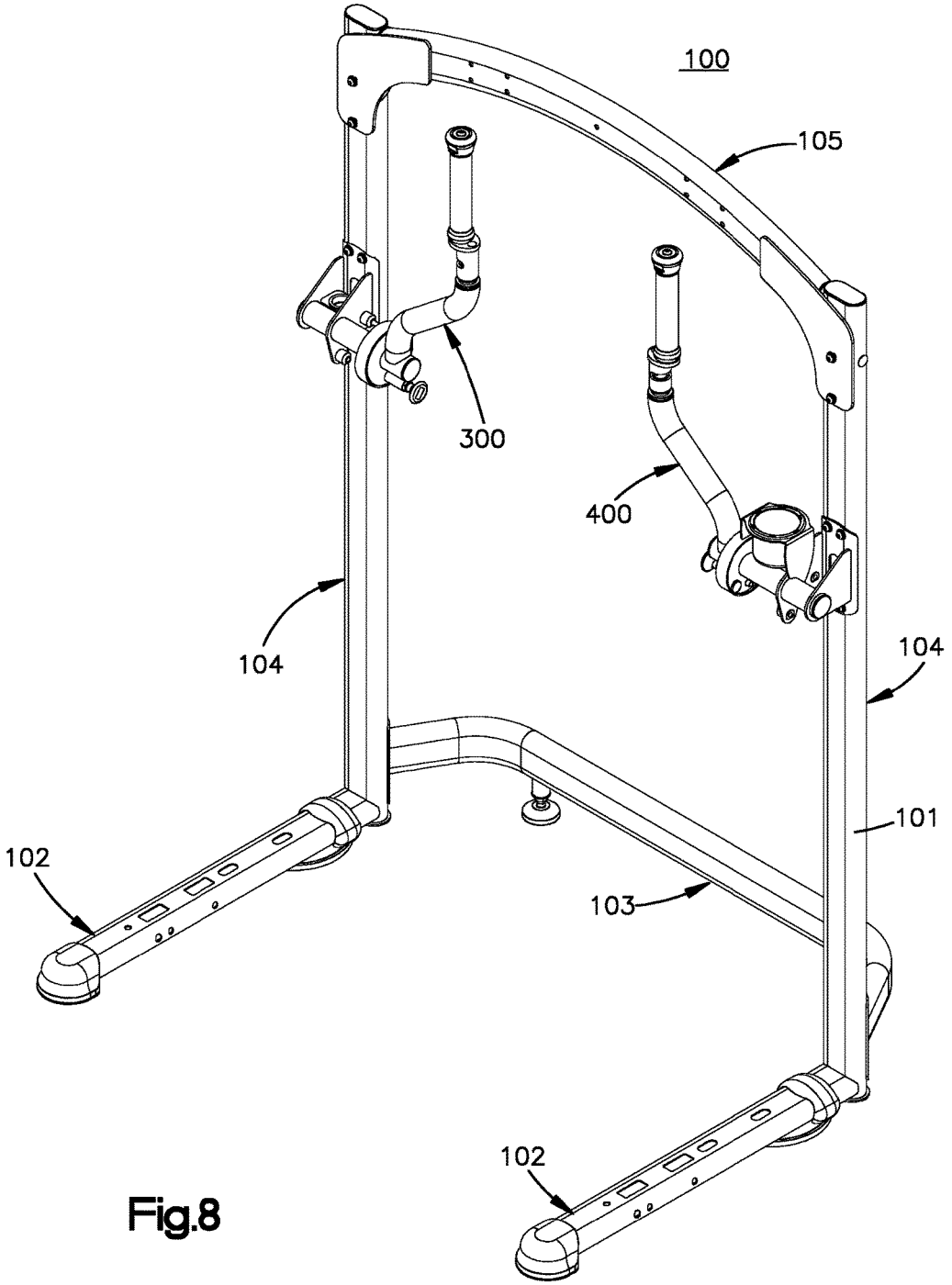
FIG. 8 is a back-right side isometric view of the dual hi-lo pulley functional trainer unit as depicted in FIG. 5, but with many parts of the exercise machine omitted to more clearly show the flip and dip handle system.

As best illustrated in FIGS. 7 and 8, the exercise machine 100 of the illustrated embodiment further includes a left dip handle assembly 300 and a right dip handle assembly 400, each mounted on a support upright 104 of the main frame 101. The left dip handle assembly 300, including all of its components, is shown with more detail in FIG. 9. The left dip handle assembly 300 includes a mounting bracket 301 that attaches the left dip handle assembly 300 to the left support upright 104. According to the depicted embodiment, fasteners 302, such as bolts, screws, nuts, washers, and/or rivets attach the mounting bracket 301 to the left support upright 104. However, one of ordinary skill in the art will appreciate that the mounting bracket 301 may be attached through other means known in the art, including without limitation, through welding, adhesives, pins, hooks, or other mechanical interfaces and attaching methods known in the art. The method of attaching may allow the mounting bracket 301 to be adjusted vertically along support upright 104, or mounted on support upright 104 at a selected height, so that the height of the left dip handle assembly 300 can be selectively adjusted.

Figure 9:
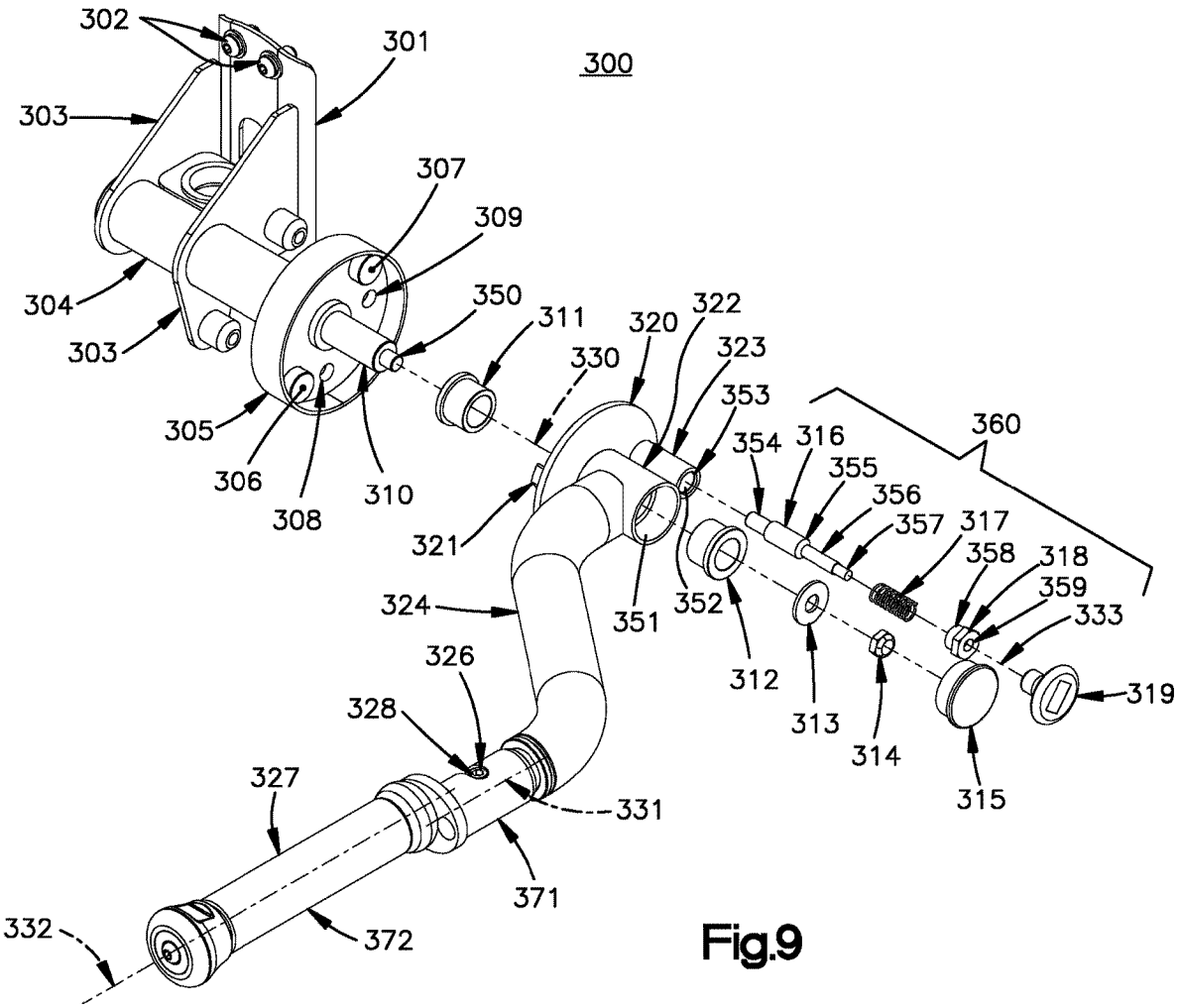
FIG. 9 is an exploded view of a left dip handle assembly of a flip and dip handle system.

Referring still to FIG. 9, the left dip handle assembly 300 further includes a pair of reinforcing ribs 303 connected to the mounting bracket 301 and a support rod 304 connected to the reinforcing ribs 303. The support rod 304 is connected to and supports an arm mount hub 305. The arm mount hub 305, according to the depicted embodiment, is a round housing that includes an exercise position stop lug 306 and a storage position stop lug 307. The arm mount hub 305 further includes an exercise position lock hole 309 and a storage position lock hole 308. A pivot shaft 310 extends from the center of the arm mount hub 305. The pivot shaft 310 of the depicted embodiment is 1 inch in diameter and includes a threaded end 350 for retaining a bearing housing 322 on the pivot shaft 310. The threaded end 350 includes ½-13 UNC male threads. However, one of ordinary skill in the art will appreciate that the bearing housing 322 may be retained on the pivot shaft 310 through other means known in the art, including without limitation, cotter pins, e-clips or c-clips, pressed retainers or fittings, male or female threads, and other methods known in the art.

The bearing housing 322 is rotatably mounted on the pivot shaft 310 for rotation about pivot axis 330. The pivot shaft 310 is inserted through an inner bearing 311, a bearing bore 351 in the bearing housing 322, and an outer bearing 312. Thus, the bearing housing 322 rides on the inner and outer bearings 311, 312. The inner and outer bearings 311, 312 are preferably made from a low-friction material that will not increase the rotating friction between the bearing housing 322 and the pivot shaft 310, allowing the bearing housing 322 to freely rotate about pivot axis 330. The inner and outer bearings 311, 312 are also preferably made from a material that is softer than that of the pivot shaft 310 and the bearing housing 322, such that any wear resulting from rotation of the bearing housing 322 occurs on the inner and outer bearings 311, 312, which are easier and less expensive to replace as wear or maintenance items. As non-limiting examples, the inner and outer bearings 311, 312 may be made from aluminum, brass or bronze, thermoplastics such as nylon, or they may include a Teflon coating.

According to the embodiment of FIG. 9, a washer 313 and a locknut 314 threaded onto the threaded end 350 of the pivot shaft 310 retain the bearing housing 322 on the pivot shaft 310. The washer 313 is a ½" USS flat washer, while the locknut 314 is a ½-13 UNC locknut. As discussed above, however, the bearing housing 322 may be retained on the pivot shaft 310 through other means known in the art. An end cap 315 is inserted into the bearing bore 351 of bearing housing 322.

As further illustrated in FIG. 9, the bearing housing 322 is connected to a stop plate 320, which includes a stop feature 321. The stop feature 321 engages the respective exercise position stop lug 306 and storage position stop lug 307, when the bearing housing 322 rotates about pivot axis 330 between the exercise position and the storage position, as described in more detail below.

A pull-pin barrel 323 is connected to stop plate 320 and the bearing housing 322. The pull-pin barrel 323 includes a pull-pin bore 352 with a female-threaded opening 353. A spring-loaded pull pin 360 is assembled into the pull-pin bore 352 of the pull-pin barrel 323. The spring-loaded pull pin 360 includes a pull-pin plunger 316 that has a first end 354 for selectively engaging the respective exercise position lock hole 309 or the storage position lock hole 308, to lock the left dip handle assembly 300 into either the exercise position or storage position, as described in more detail below. The pull-pin plunger 316 also includes a first intermediate section 355, which provides a clearance fit with the pull-pin bore 352 of the pull-pin barrel 323 and allows the spring-loaded pull pin 360 to slide along axis 333 within the pull-pin bore 352. The pull-pin plunger 316 further includes a second intermediate section 356, smaller in diameter than the first intermediate section 355, on which a spring 317 is mounted. And the pull-pin plunger 316 includes a threaded end 357 with male threads.

As illustrated in FIG. 9, the pull-pin plunger 316 of the spring-loaded pull pin 360 is inserted into the pull-pin bore 352 of the pull-pin barrel 323, with the spring 317 mounted onto the second intermediate section 356. A barrel cap 318 retains the pull-pin plunger 316 and spring 317 within the pull-pin bore 352 of the pull-pin barrel 323. The barrel cap 318 includes male threads 358 that engage the female-threaded opening 353 of the pull-pin barrel 323. Thus, the barrel cap 318 screws into the pull-pin bore 352 of the pull-pin barrel 323, retaining the pull-pin plunger 316 and spring 317 within the pull-pin bore 352. The barrel cap 318 includes a hole 359 through which the second intermediate section 356 of the pull-pin plunger 316 is inserted. The second intermediate section 356 of the pull-pin plunger 316 has a clearance fit with the hole 359, which allows the pull-pin plunger 316 to slide along axis 333. A threaded knob 319 is threaded onto the threaded end 357 of the pull-pin plunger 316.

As mentioned above, the spring 317 is mounted on the second intermediate section 356 of the pull-pin plunger 316. After the barrel cap 318 is screwed into the female-threaded opening 353, the spring 317 is compressed between the larger diameter first intermediate section 355 and the barrel cap 318. Because the barrel cap 318 is fixed to the pull-pin barrel 323, while the pull-pin plunger 316 is slidable along axis 333, the spring 317 biases the pull-pin plunger 316 toward the arm mount hub 305. Accordingly, the spring 317 biases the first end 354 of the pull-pin plunger 316 into the exercise position lock hole 309 when the left dip handle assembly 300 is in the exercise position, or into the storage position lock hole 308 when the left dip handle assembly 300 is in the storage position.

As further shown in FIG. 9, an exercise arm 324 extends from the bearing housing 322. The end of the exercise arm 324 opposite the bearing housing 322 has a longitudinal axis 331 and a stop feature 326. An adjustable dip handle 327 is mounted on the exercise arm 324. The adjustable dip handle 327 includes a mounting portion 371 and a grip portion 372. The mounting portion 371 is rotatably mounted on the exercise arm 324 such that it its longitudinal axis is coincident with the longitudinal axis 331 of the end of the exercise arm 324, and such that the adjustable dip handle 327 may rotate about longitudinal axis 331. The mounting portion 371 includes a slot 328 that extends at least approximately 180° around the circumference of the mounting portion 371. The stop feature 326 of the exercise arm 324 is located within the slot 328, and is configured to limit the adjustable dip handle's 327 rotation about longitudinal axis 331 by engaging the ends of the slot 328 to provide wide (FIGS. 1, 3, 7, 9) and narrow grip positions for the adjustable dip handle 327.

The grip portion 372 of the adjustable dip handle 327 has a second longitudinal axis 332 that is not coincident with longitudinal axis 331. Thus, the adjustable handle 327 can be rotated at least approximately 180° about longitudinal axis 331, in which case the grip portion 372 rotates in an arcuate path about longitudinal axis 331 between the wide and narrow grip positions. The adjustable dip handle 327 is similar to the dip bar handles 60 described in U.S. Patent Application Publication No. 2012-0329626 A1, which is herein incorporated by reference.

As best illustrated in FIGS. 7 and 8, the exercise machine 100 of the illustrated embodiment further includes a similar right dip handle assembly 400 mounted on a support upright 104 of the main frame 101. The right dip handle assembly 400, including all of its components, is shown with more detail in FIG. 10. The right dip handle assembly 400 includes a mounting bracket 401 that attaches the right dip handle assembly 400 to the right support upright 104. According to the depicted embodiment, fasteners 402, such as bolts, screws, nuts, washers, and/or rivets attach the mounting bracket 401 to the support upright 104. However, as discussed above with respect to the fasteners 302, one of ordinary skill in the art will appreciate that the mounting bracket 401 may be attached through other means known in the art. The method of attaching may allow the mounting bracket 401 to be adjusted vertically along support upright 104, or mounted on support upright 104 at a selected height, so that the height of the right dip handle assembly 400 can be selectively adjusted.

Figure 10:
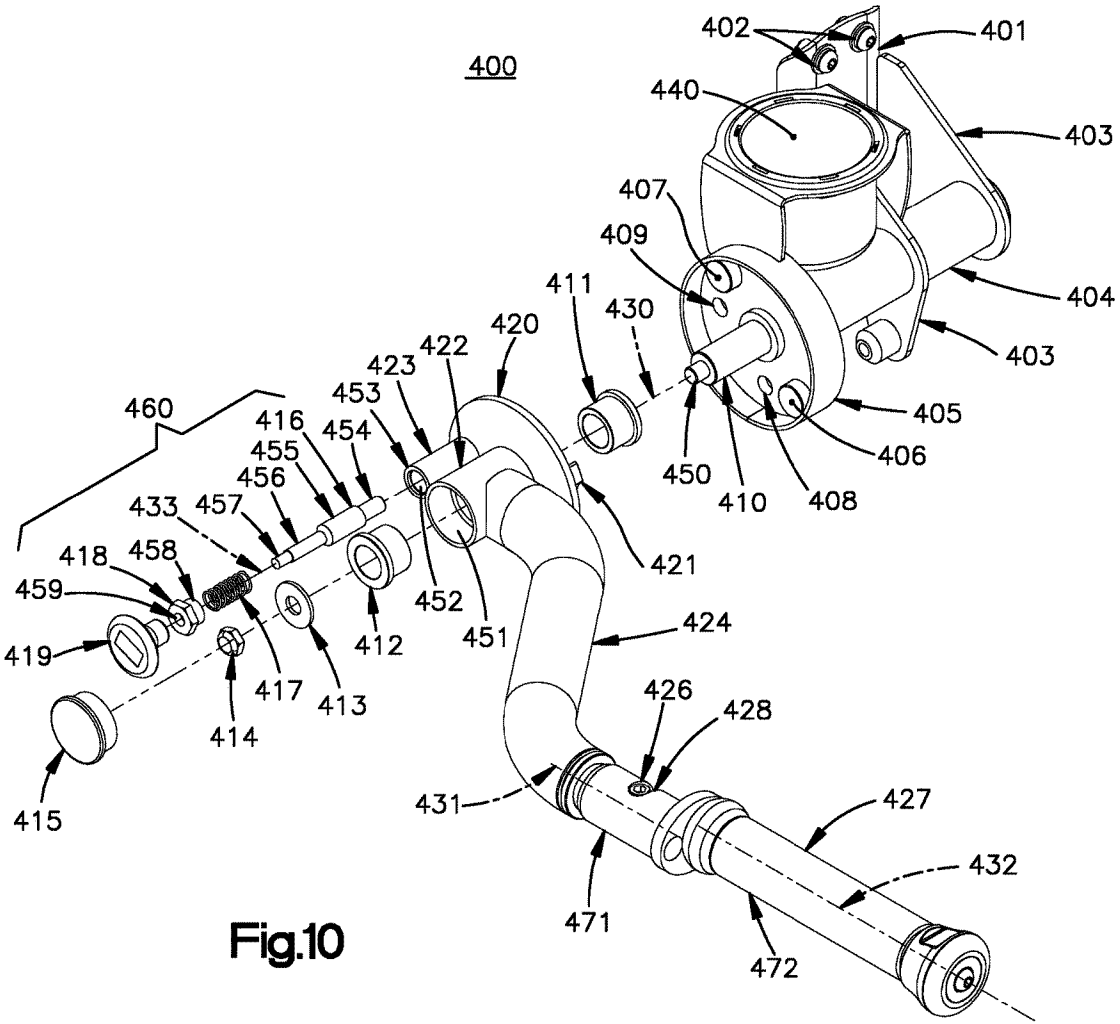
FIG. 10 is an exploded view of a right dip handle assembly of a flip and dip handle system.

Referring still to FIG. 10, the right dip handle assembly 400 further includes a pair of reinforcing ribs 403 connected to the mounting bracket 401 and a support rod 404 connected to the reinforcing ribs 403. The support rod 404 is connected to and supports an arm mount hub 405. The right dip handle assembly 400 depicted in FIG. 10 further includes a drink holder 440 mounted to one or more of the mounting bracket 401, reinforcing ribs 403, support rod 404, and arm mount hub 405. One skilled in the art will appreciate that the drink holder 440 may optionally be included on the left dip handle assembly 300, if preferred.

The arm mount hub 405, according to the depicted embodiment, is a round housing that includes an exercise position stop lug 406 and a storage position stop lug 407. The arm mount hub 405 further includes an exercise position lock hole 409 and a storage position lock hole 408. A pivot shaft 410 extends from the center of the arm mount hub 405. The pivot shaft 410 of the depicted embodiment is 1 inch in diameter and includes a threaded end 450 for retaining a bearing housing 422 on the pivot shaft 410. The threaded end 450 includes ½-13 UNC male threads. However, as discussed above with respect to the left dip handle assembly's 300 bearing housing 322, one of ordinary skill in the art will appreciate that the bearing housing 422 may be retained on the pivot shaft 410 through other means known in the art.

The bearing housing 422 is rotatably mounted on the pivot shaft 410 for rotation about pivot axis 430. The pivot shaft 410 is inserted through an inner bearing 411, a bearing bore 451 in the bearing housing 422, and an outer bearing 412. Thus, the bearing housing 422 rides on the inner and outer bearings 411, 412. The inner and outer bearings 411, 412 (like inner and outer bearings 311, 312) are preferably made from a low-friction material that will not increase the rotating friction between the bearing housing 422 and the pivot shaft 410, allowing the bearing housing 422 to freely rotate about pivot axis 430. The inner and outer bearings 411, 412 are also preferably made from a material that is softer than that of the pivot shaft 410 and the bearing housing 422, such that any wear resulting from rotation of the bearing housing 422 occurs on the inner and outer bearings 411, 412, which are easier and less expensive to replace as wear or maintenance items. As non-limiting examples, the inner and outer bearings 411, 412 may be made from aluminum, brass or bronze, thermoplastics such as nylon, or they may include a Teflon coating.

According to the embodiment of FIG. 10, a washer 413 and a locknut 414 threaded onto the threaded end 450 of the pivot shaft 410 retain the bearing housing 422 on the pivot shaft 410. The washer 413 is a ½" USS flat washer, while the locknut 414 is a ½-13 UNC locknut. As discussed above, however, the bearing housing 422 may be retained on the pivot shaft 410 through other means known in the art. An end cap 415 is inserted into the bearing bore 451 of bearing housing 422.

As further illustrated in FIG. 10, the bearing housing 422 is connected to a stop plate 420, which includes a stop feature 421. The stop feature 421 engages the respective exercise position stop lug 406 and storage position stop lug 407, when the bearing housing 422 rotates about pivot axis 430 between the exercise position and the storage position, as described in more detail below.

A pull-pin barrel 423 is connected to stop plate 420 and the bearing housing 422. The pull-pin barrel 423 includes a pull-pin bore 452 with a female-threaded opening 453. A spring-loaded pull pin 460 is assembled into the pull-pin bore 452 of the pull-pin barrel 423. The spring-loaded pull pin 460 includes a pull-pin plunger 416 that has a first end 454 for selectively engaging the respective exercise position lock hole 409 or the storage position lock hole 408, to lock the right dip handle assembly 400 into either the exercise position or storage position, as described in more detail below. The pull-pin plunger 416 also includes a first intermediate section 455, which provides a clearance fit with the pull-pin bore 452 of the pull-pin barrel 423 and allows the spring-loaded pull pin 460 to slide along axis 433 within the pull-pin bore 452. The pull-pin plunger 416 further includes a second intermediate section 456, smaller in diameter than the first intermediate section 455, on which a spring 417 is mounted. And the pull-pin plunger 416 includes a threaded end 457 with male threads.

As illustrated in FIG. 10, the pull-pin plunger 416 of the spring-loaded pull pin 460 is inserted into the pull-pin bore 452 of the pull-pin barrel 423, with the spring 417 mounted onto the second intermediate section 456. A barrel cap 418 retains the pull-pin plunger 416 and spring 417 within the pull-pin bore 452 of the pull-pin barrel 423. The barrel cap 418 includes male threads 458 that engage the female-threaded opening 453 of the pull-pin barrel 423. Thus, the barrel cap 418 screws into the pull-pin bore 452 of the pull-pin barrel 423, retaining the pull-pin plunger 416 and spring 417 within the pull-pin bore 452. The barrel cap 418 includes a hole 459 through which the second intermediate section 456 of the pull-pin plunger 416 is inserted. The second intermediate section 456 of the pull-pin plunger 416 has a clearance fit with the hole 459, which allows the pull-pin plunger 416 to slide along axis 433. A threaded knob 419 is threaded onto the threaded end 457 of the pull-pin plunger 416.

As mentioned above, the spring 417 is mounted on the second intermediate section 456 of the pull-pin plunger 416. After the barrel cap 418 is screwed into the female-threaded opening 453, the spring 417 is compressed between the larger diameter first intermediate section 455 and the barrel cap 418. Because the barrel cap 418 is fixed to the pull-pin barrel 423, while the pull-pin plunger 416 is slidable along axis 433, the spring 417 biases the pull-pin plunger 416 toward the arm mount hub 405. Accordingly, the spring 417 biases the first end 454 of the pull-pin plunger 416 into the exercise position lock hole 409 when the right dip handle assembly 400 is in the exercise position, or into the storage position lock hole 408 when the right dip handle assembly 400 is in the storage position.

As further shown in FIG. 10, an exercise arm 424 extends from the bearing housing 422. The end of the exercise arm 424 opposite the bearing housing 422 has a longitudinal axis 431 and a stop feature 426. An adjustable dip handle 427 is mounted on the exercise arm 424. The adjustable dip handle 427 includes a mounting portion 471 and a grip portion 472. The mounting portion 471 is rotatably mounted on the exercise arm 424 such that it its longitudinal axis is coincident with the longitudinal axis 431 of the end of the exercise arm 424, and such that the adjustable dip handle 427 may rotate about longitudinal axis 431. The mounting portion 471 includes a slot 428 that extends at least approximately 180° around the circumference of the mounting portion 471. The stop feature 426 of the exercise arm 424 is located within the slot 428, and is configured to limit the adjustable dip handle's 427 rotation about longitudinal axis 431 by engaging the ends of the slot 428 to provide wide (FIGS. 1, 3, 7, 10) and narrow grip positions for the adjustable dip handle 427.

The grip portion 472 of the adjustable dip handle 427 has a second longitudinal axis 432 that is not coincident with longitudinal axis 431. Thus, the adjustable handle 427 can be rotated at least approximately 180° about longitudinal axis 431, in which case the grip portion 472 rotates in an arcuate path about longitudinal axis 431 between the wide and narrow grip positions. The adjustable dip handle 427 is similar to the dip bar handles 60 described in U.S. Patent Application Publication No. 2012-0329626 A1, which is herein incorporated by reference.

The operation and use of the right dip handle assembly 400 will now be described with reference to FIGS. 11-20. It is to be understood that the operation and use of the left dip handle assembly 300 is an identical mirror image of that of the right dip handle assembly 400.

Figure 13:
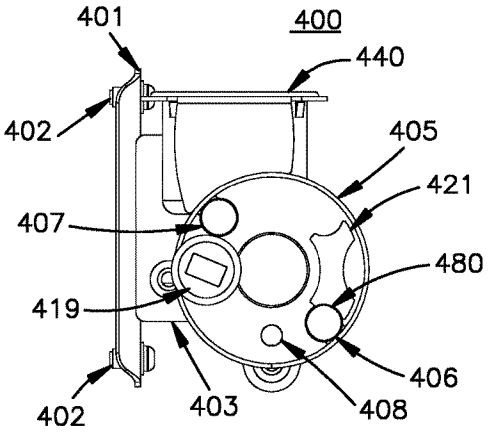
FIG. 13 is a left side view of the right dip handle assembly as depicted in FIG. 12, but with some parts omitted to more clearly show the engagement of the stop feature with the exercise position stop lug when the dip handle assembly is in the exercise position.
Figure 11:
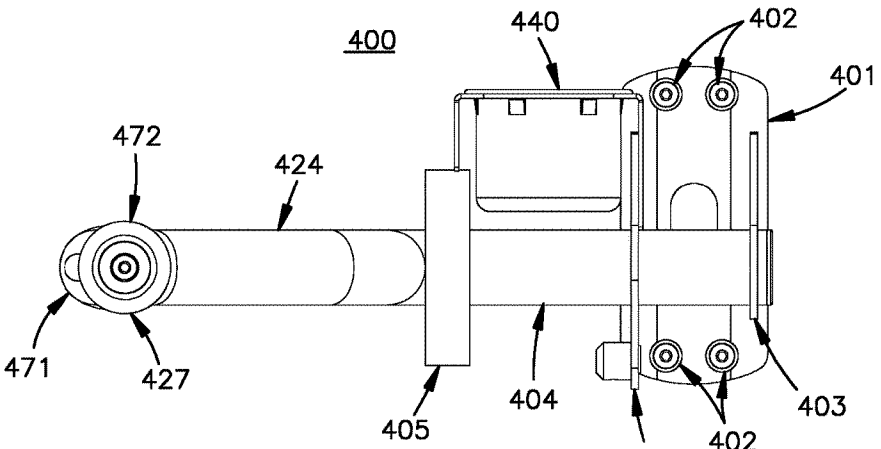
FIG. 11 is a back side view of the right dip handle assembly as depicted in FIG. 10, with the dip handle assembly in the exercise position.
Figure 12:
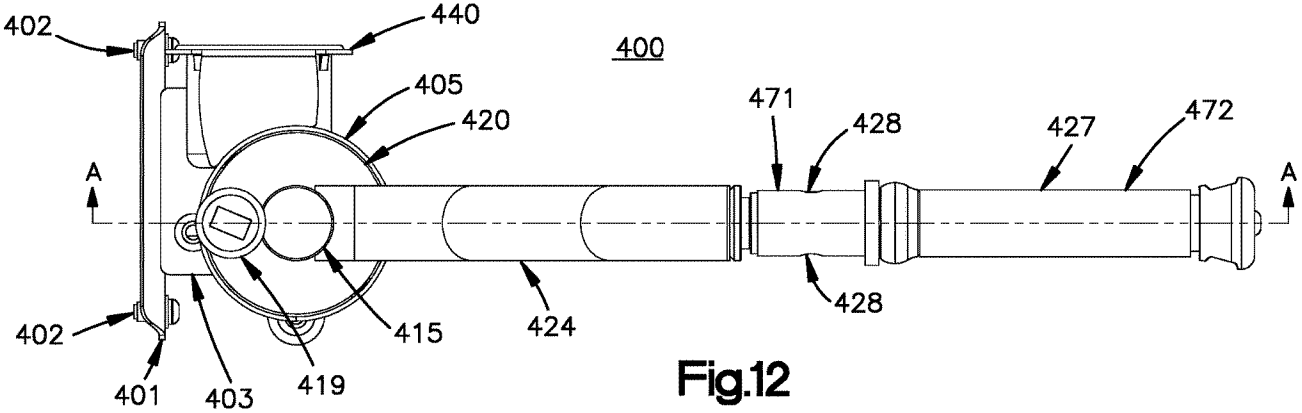
FIG. 12 is a left side view of the right dip handle assembly as depicted in FIG. 11.

FIGS. 11-15 depict the right dip handle assembly 400 in an exercise position. That is, the exercise arm 424 and adjustable dip handle 427 are rotated about pivot axis 430 so that they lie in a substantially horizontal plane. (See also FIGS. 1-4 and 7.) When the exercise arm 424 and adjustable dip handle 427 are rotated toward the exercise position, the bearing housing 422 rotates about pivot axis 430 on the pivot shaft 410. Along with the bearing housing 422, the stop plate 420 rotates about pivot axis 430 with respect to the arm mount hub 405. Accordingly, the stop feature 421 rotates about pivot axis 430 until it contacts the exercise position stop lug 406. FIG. 13 depicts the right dip handle assembly 400 in the exercise position with components omitted to illustrate the contact point 480 between the stop feature 421 and the exercise position stop lug 406.

Figure 14:
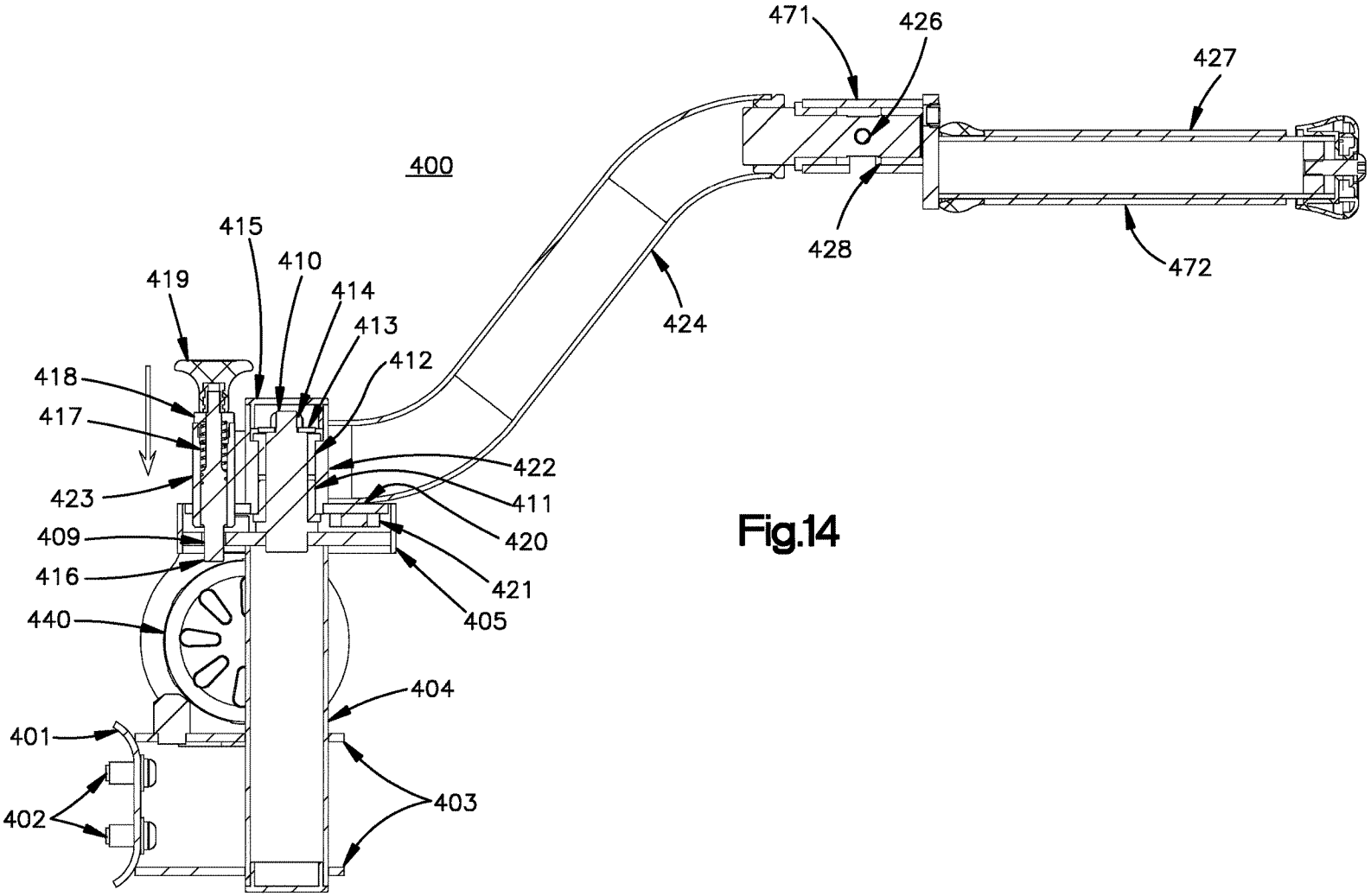
FIG. 14 is a cross-sectional view of the right dip handle assembly according to cross-section A-A depicted in FIG. 12, with the pull pin engaged to lock the dip handle assembly in the exercise position.
Figure 15:
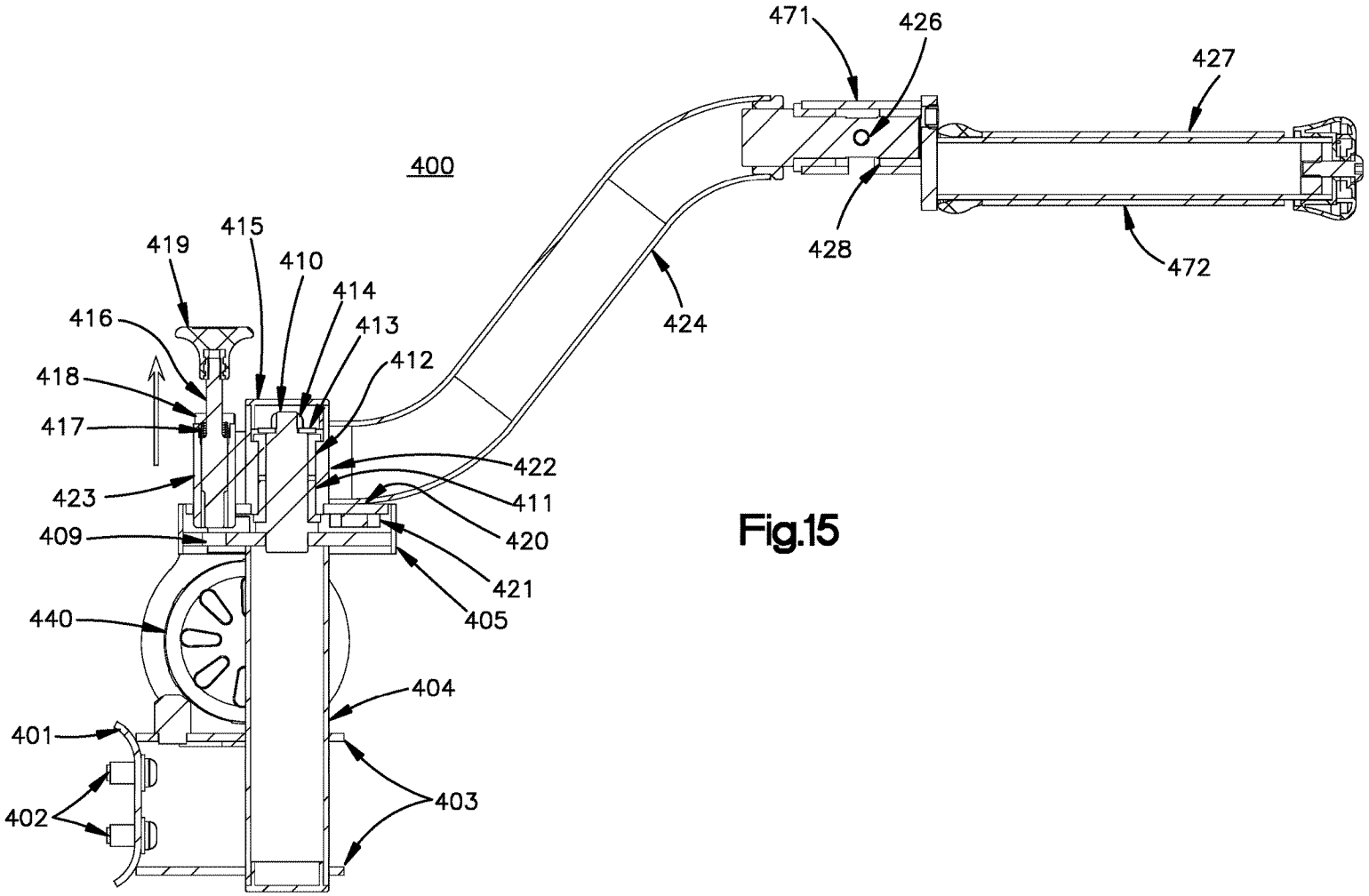
FIG. 15 is a cross-sectional view of the right dip handle assembly according to cross-section A-A depicted in FIG. 12, with the pull pin disengaged so that the dip handle assembly may be rotated away from the exercise position.

Similarly, as the bearing housing 422 rotates about pivot axis 430 toward the exercise position, the pull-pin barrel 423 and spring-loaded pull pin 460 rotate about pivot axis 430 with respect to the arm mount hub 405. Thus, the spring-loaded pull pin 460 rotates about pivot axis 430 until the first end 454 of the pull-pin plunger 416 aligns with the exercise position lock hole 409. As discussed above, the spring 417 biases the pull-pin plunger 416 toward the arm mount hub 405, which means that the pull-pin plunger 416 is biased into the exercise position lock hole 409 when the right dip handle assembly 400 is in the exercise position. FIG. 14 depicts the right dip handle assembly 400 in the exercise position with pull-pin plunger 416 inserted into the exercise position lock hole 409. The user may pull on the threaded knob 419 to overcome the biasing force of the spring 417 and withdraw the pull-pin plunger 416 from the exercise position lock hole 409, in order to rotate the right dip handle assembly 400 away from the exercise position. FIG. 15 depicts the right dip handle assembly 400 in the exercise position with the pull-pin plunger 416 withdrawn from the exercise position lock hole 409.

The right dip handle assembly 400 thus utilizes two methods of locating and positioning the right dip handle assembly 400 in the exercise position. First, the stop feature 421 contacts the exercise position stop lug 406 to locate and position the right dip handle assembly 400 in the exercise position. And second, the pull-pin plunger 416 is biased into the exercise position lock hole 409 to further locate and position the right dip handle assembly 400 in the exercise position, and to more affirmatively lock the right dip handle assembly 400 in the exercise position.

Figure 18:
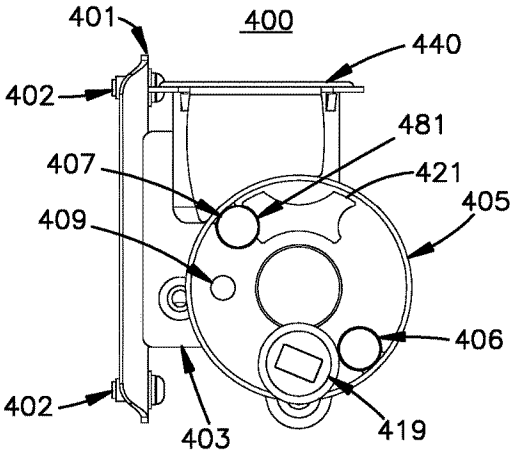
FIG. 18 is a left side view of the right dip handle assembly as depicted in FIG. 17, but with some parts omitted to more clearly show the engagement of the stop feature with the storage position stop lug when the dip handle assembly is in the storage position.
Figure 16:
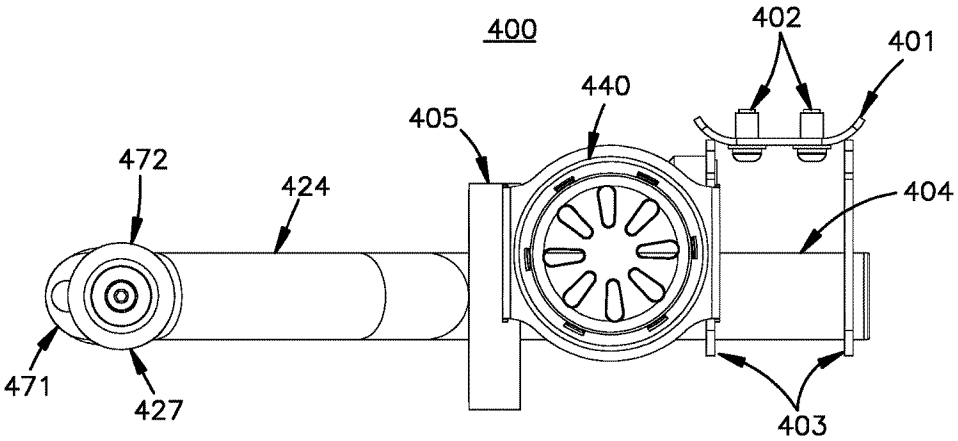
FIG. 16 is a top side view of the right dip handle assembly as depicted in FIG. 10, with the dip handle assembly in the storage position.
Figure 17:
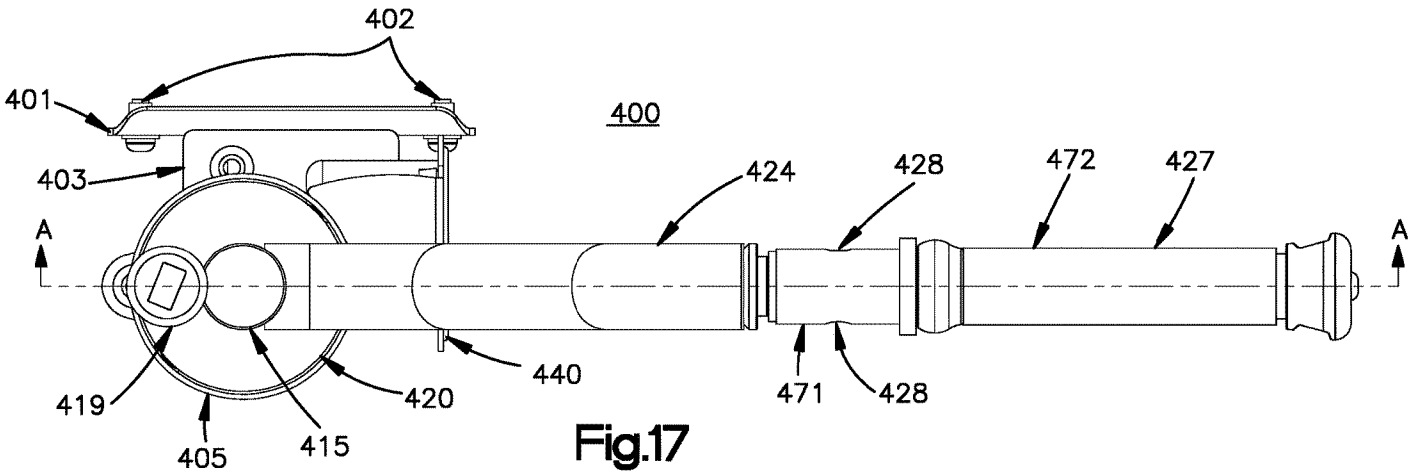
FIG. 17 is a left side view of the right dip handle assembly as depicted in FIG. 16.

In contrast with FIGS. 11-15, FIGS. 16-18 depict the right dip handle assembly 400 in a storage position. That is, the exercise arm 424 and adjustable dip handle 427 are rotated about pivot axis 430 so that they lie in a substantially vertical plane. (See also FIGS. 5-6 and 8.) When the exercise arm 424 and adjustable dip handle 427 are rotated toward the storage position, the bearing housing 422 rotates about pivot axis 430 on the pivot shaft 410. Along with the bearing housing 422, the stop plate 420 rotates about pivot axis 430 with respect to the arm mount hub 405. Accordingly, the stop feature 421 rotates about pivot axis 430 until it contacts the storage position stop lug 407. FIG. 18 depicts the right dip handle assembly 400 in the storage position with components omitted to illustrate the contact point 481 between the stop feature 421 and the storage position stop lug 407.

Figure 19:
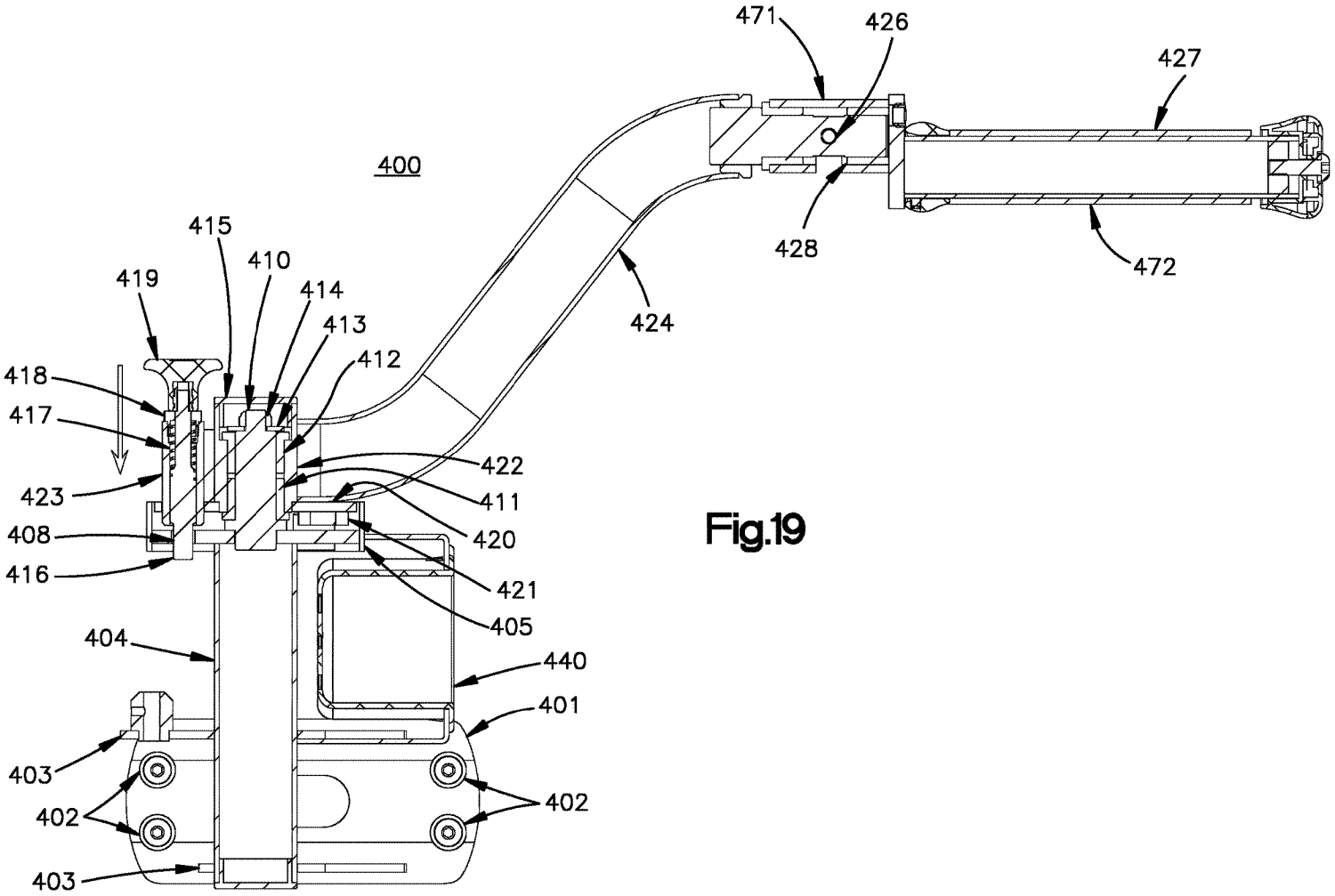
FIG. 19 is a cross-sectional view of the right dip handle assembly according to cross-section A-A depicted in FIG. 17, with the pull pin engaged to lock the dip handle assembly in the storage position.

Similarly, as the bearing housing 422 rotates about pivot axis 430 toward the storage position, the pull-pin barrel 423 and spring-loaded pull pin 460 rotate about pivot axis 430 with respect to the arm mount hub 405. Thus, the spring-loaded pull pin 460 rotates about pivot axis 430 until the first end 454 of the pull-pin plunger 416 aligns with the storage position lock hole 408. As discussed above, the spring 417 biases the pull-pin plunger 416 toward the arm mount hub 405, which means that the pull-pin plunger 416 is biased into the storage position lock hole 408 when the right dip handle assembly 400 is in the storage position. FIG. 19 depicts the right dip handle assembly 400 in the storage position with pull-pin plunger 416 inserted into the storage position lock hole 408. As discussed above with respect to the exercise position, the user may pull on the threaded knob 419 to overcome the biasing force of the spring 417 and withdraw the pull-pin plunger 416 from the storage position lock hole 408, in order to rotate the right dip handle assembly 400 away from the storage position.

The right dip handle assembly 400 thus utilizes two methods of locating and positioning the right dip handle assembly 400 in the storage position. The stop feature 421 contacts the storage position stop lug 407 to locate and position the right dip handle assembly 400 in the storage position. And the pull-pin plunger 416 is biased into the storage position lock hole 408 to further locate and position the right dip handle assembly 400 in the storage position, and to more affirmatively lock the right dip handle assembly 400 in the storage position.

Figure 20:
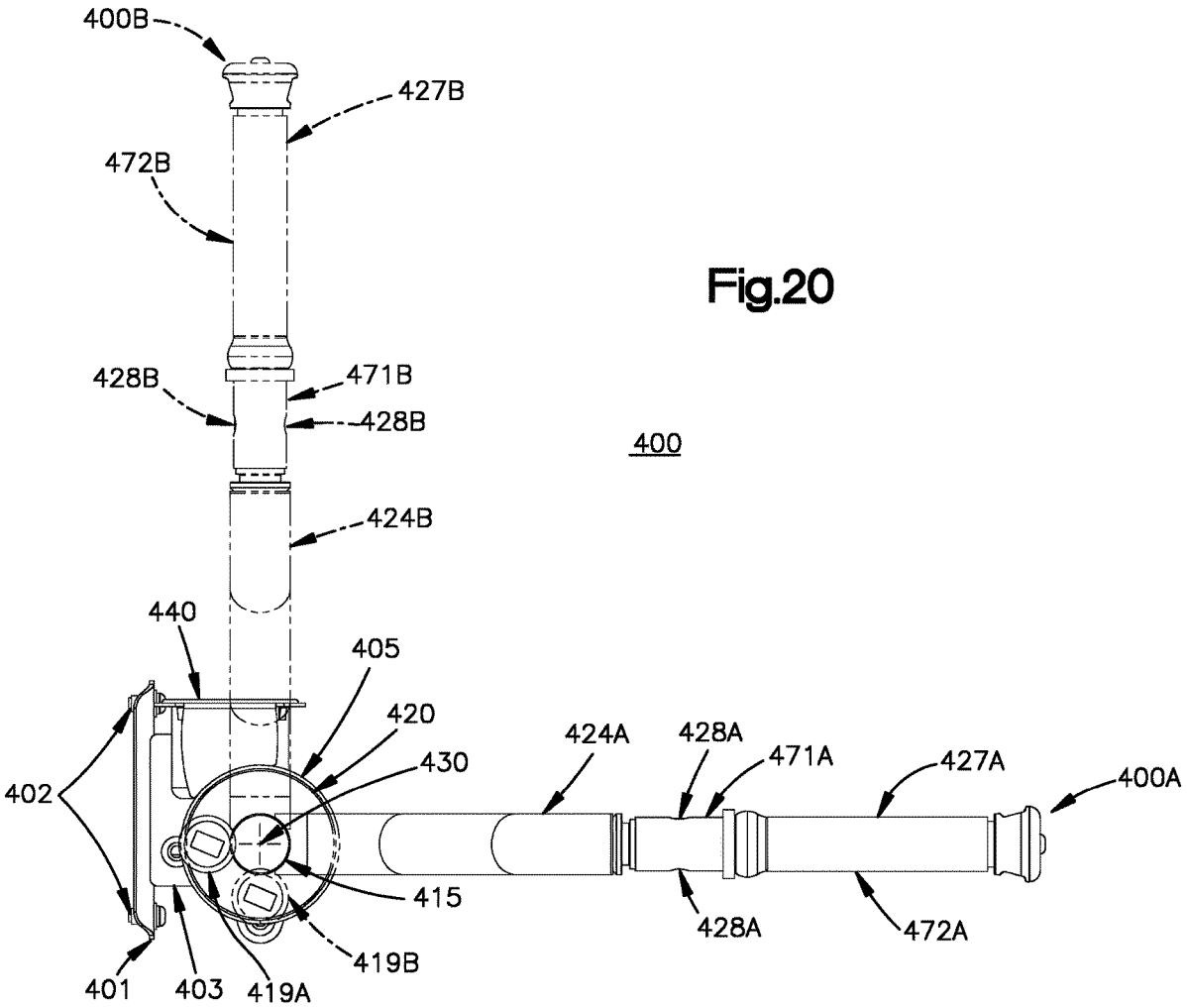
FIG. 20 is a left side, superimposed view of the right dip handle assembly as depicted in FIG. 10, with the dip handle assembly in the exercise position (shown in solid lines) and the dip handle assembly in the storage position (shown in dashed lines).

FIG. 20 illustrates the right dip handle assembly 400 in the exercise position (400A) superimposed upon the right dip handle assembly 400 in the storage position (400B). As shown, in the exercise position 400A, the exercise arm 424 and adjustable dip handle 427 are substantially horizontal. And in the storage position 400B, the exercise arm 424 and adjustable dip handle 427 have been rotated approximately 90° to lie in a substantially vertical plane. Furthermore, the spring-loaded pull pin 460 has rotated approximately 90° about pivot axis 430, as represented in FIG. 20 by the relative positions of the threaded knob 419A, 419B. Thus, the spring-loaded pull pin 460 has rotated between positions where it is engaged with the respective exercise position lock hole 409 and storage position lock hole 408 (see FIGS. 13 and 18).

LIST OF REFERENCE NUMERALS

100 - exercise machine
101 - main frame
102 - horizontal side strut
103 - horizontal cross strut
104 - support upright
105 - horizontal connecting strut
106 - pull-up grip
107 - vertical column
108 - lower pivot mount
109 - upper pivot mount
110 - pulley carriage
111 - pull end
112 - selectorized weight stack
116 - adjustable pull-up grip
200 - exerciser
300 - left dip handle assembly
301 - mounting bracket
302 - fastener -continued 303 - reinforcing rib
304 - support rod
305 - arm mount hub
306 - exercise position stop lug
307 - storage position stop lug
308 - storage position lock hole
309 - exercise position lock hole
310 - pivot shaft
311 - inner bearing
312 - outer bearing
313 - washer
314 - locknut
315 - end cap
316 - pull-pin plunger
317 - spring
318 - barrel cap
319 - threaded knob
320 - stop plate
321 - stop feature
322 - bearing housing
323 - pull-pin barrel
324 - exercise arm
326 - stop feature
327 - adjustable dip handle
328 - slot
330 - pivot axis
331 - longitudinal axis
332 - second longitudinal axis
333 - axis
350 - threaded end
351 - bearing bore
352 - pull-pin bore
353 - female-threaded opening
354 - first end
355 - first intermediate section
356 - second intermediate section
357 - threaded end
358 - male threads
359 - hole
360 - spring-loaded pull pin
371 - mounting portion
372 - grip portion
400 - right dip handle assembly
401 - mounting bracket
402 - fastener
403 - reinforcing rib
404 - support rod
405 - arm mount hub
406 - exercise position stop lug
407 - storage position stop lug
408 - storage position lock hole
409 - exercise position lock hole
410 - pivot shaft
411 - inner bearing
412 - outer bearing
413 - washer
414 - locknut
415 - end cap
416 - pull-pin plunger
417 - spring
418 - barrel cap
419 - threaded knob
420 - stop plate
421 - stop feature
422 - bearing housing
423 - pull-pin barrel
424 - exercise arm
426 - stop feature
427 - adjustable dip handle
428 - slot
430 - pivot axis
431 - longitudinal axis
432 - second longitudinal axis
433 - axis
440 - drink holder
450 - threaded end
451 - bearing bore
452 - pull-pin bore
453 - female-threaded opening -continued 454 - first end
455 - first intermediate section
456 - second intermediate section
457 - threaded end
458 - male threads
459 - hole
460 - spring-loaded pull pin
471 - mounting portion
472 - grip portion
480 - contact point
481 - contact point The list of reference numerals is provided for convenience and is intended to aid understanding of the illustrated embodiments described above. The embodiments of the present invention may be described in many different forms and should not be construed as limited to the illustrated embodiments. Likewise, the list above setting forth the reference numerals and associated components comprising the illustrated embodiments do not limit the scope of the invention as recited in the claims that follow.

What is claimed:

1. An exercise machine for performing dip exercises, comprising:

a stationary main frame having a pair of vertical supports, wherein each vertical support has a movable pulley carriage disposed thereon;

a first mounting bracket connected to the stationary main frame;

a first dip handle assembly connected to the first mounting bracket, the first dip handle assembly comprising a first exercise arm, a first stop plate, and a first arm mount hub;

a second mounting bracket connected to the stationary main frame;

a second dip handle assembly connected to the second mounting bracket, the second dip handle assembly comprising a second exercise arm, a second stop plate, and a second arm mount hub, and wherein the first and second dip handle assemblies are each configured to be converted between an exercise position and a storage position while connected to the exercise machine, and wherein the first and second dip handle assemblies are disposed between the pair of vertical supports.

2. The exercise machine of claim 1, wherein the first dip handle assembly is pivotally mounted on the first mounting b racket for rotation about a first pivot axis and the second dip handle assembly is pivotally mounted on the second mounting bracket for rotation about a second pivot axis, and wherein the conversion of the first and second dip handle assemblies between the exercise position and the storage position comprises: a rotation of the first dip handle assembly about the first pivot axis and a rotation of the second dip handle assembly about the second pivot axis.

3. The exercise machine of claim 1, wherein the first and second arm mount hubs each comprise one or more stop lugs and one or more lock holes.

4. The exercise machine of claim 1, wherein the first and second arm mount hubs each comprise an exercise position stop lug and a storage position stop lug.

5. The exercise machine of claim 1, wherein the first and second arm mount hubs each comprise an exercise position lock hole and a storage position lock hole.

6. The exercise machine of claim 3, wherein the first stop plate substantially covers the first arm mount hub and the second stop plate substantially covers the second arm mount hub.

7. The exercise machine of claim 3, wherein the first and second stop plates each include at least one stop.

8. The exercise machine of claim 3, wherein the first and second stop plates each include at least one stop, and wherein the stops of the first and second stop plates interact with the stop lugs of the respective first and second arm mount hubs for positioning the respective first and second exercise arms.

9. An exercise machine for performing dip exercises, comprising:

a stationary main frame having a pair of vertical supports, wherein each vertical support has a movable pulley carriage disposed thereon;

a first dip handle assembly associated with the stationary main frame, the first dip handle assembly comprising a first exercise arm, a first stop plate, and a first arm mount hub;

a second dip handle assembly associated with the stationary main frame, the second dip handle assembly comprising a second exercise arm, a second stop plate, and a second arm mount hub, wherein the first and second arm mount hubs each comprise one or more stop lugs and one or more lock holes, and wherein the first and second dip handle assemblies are disposed between the vertical supports.

10. The exercise machine of claim 9, wherein the first and second arm mount hubs each comprise an exercise position stop lug and a storage position stop lug.

11. The exercise machine of claim 9, wherein the first and second arm mount hubs each comprise an exercise position lock hole and a storage position lock hole.

12. The exercise machine of claim 9, wherein the first stop plate substantially covers the first arm mount hub and the second stop plate substantially covers the second arm mount hub.

13. The exercise machine of claim 9, wherein the first and second stop plates each include at least one stop.

14. The exercise machine of claim 9, wherein the first and second stop plates each include at least one stop, and wherein the stops of the first and second stop plates interact with the stop lugs of the respective first and second arm mount hubs for positioning the respective first and second exercise arms.

15. The exercise machine of claim 9, wherein the first and second dip handle assemblies are configured to be converted between an exercise position and a storage position while connected to the exercise machine.

16. The exercise machine of claim 15, wherein the first dip handle assembly is pivotally mounted with respect to the stationary main frame for rotation about a first pivot axis, wherein the second dip handle assembly is pivotally mounted with respect to the stationary main frame for rotation about a second pivot axis, and wherein the conversion of the first and second dip handle assemblies between the exercise position and the storage position comprises: a rotation of the first dip handle assembly about the first pivot axis and a rotation of the second dip handle assembly about the second pivot axis.

17. An exercise machine for performing dip exercises, comprising:

a stationary main frame having a first weight stack mounted on a first side of the stationary main frame and a second weight stack mounted on a second side of the stationary main frame;

a first mounting bracket connected to the stationary main frame;

a first dip handle assembly pivotally mounted on the first mounting bracket for rotation about a first pivot axis, the first dip handle assembly comprising a first exercise arm, a first stop plate, and a first arm mount hub;

a second mounting bracket connected to the stationary main frame;

a second dip handle assembly pivotally mounted on the second mounting bracket for rotation about a second pivot axis, the second dip handle assembly comprising a second exercise arm, a second stop plate, and a second arm mount hub, wherein the first and second dip handle assemblies are configured to be independently rotated about the respective first and second pivot axes between an exercise position and a storage position, wherein when the first and second dip handle assemblies are in the exercise position, the respective first and second exercise arms are substantially horizontal, and when the first and second dip handle assemblies are in the storage position, the respective first and second exercise arms are substantially vertical, and wherein the first and second arm mount hubs each comprise a spring-loaded pull pin and one or more stop lugs and one or more lock holes, and wherein the first and second dip handle assemblies are positioned between the first and second weight stacks on the stationary frame.

18. The exercise machine of claim 17, wherein the first and second arm mount hubs each comprise an exercise position stop lug and a storage position stop lug.

19. The exercise machine of claim 17, wherein the first and second arm mount hubs each comprise an exercise position lock hole and a storage position lock hole.

20. The exercise machine of claim 17, wherein the first stop plate substantially covers the first arm mount hub and the second stop plate substantially covers the second arm mount hub.

21. The exercise machine of claim 17, wherein the first and second stop plates each comprise a stop for interacting with the one or more stop lugs of the respective first and second arm mount hubs.

* * * * *